US012286201B2

(12) United States Patent
Senoo et al.

(10) Patent No.: US 12,286,201 B2
(45) **Date of Patent: *Apr. 29, 2025**

(54) FLUID MACHINE FOR UNDERWATER VEHICLE AND UNDERWATER VEHICLE

(71) Applicant: MITSUBISHI HEAVY INDUSTRIES, LTD., Tokyo (JP)

(72) Inventors: Shigeki Senoo, Tokyo (JP); Shinichi Isobe, Tokyo (JP); Wataru Yamada, Tokyo (JP); Takehiko Nishida, Tokyo (JP); Takuyoshi Yamada, Tokyo (JP); Kazuki Hosono, Tokyo (JP); Yoshitomo Noda, Tokyo (JP); Hiroki Takeda, Tokyo (JP); Yuichi Sekine, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 563 days.

This patent is subject to a terminal disclaimer.

(21) Appl. No.: 17/700,724

(22) Filed: Mar. 22, 2022

(65) Prior Publication Data

US 2022/0315183 A1 Oct. 6, 2022

(30) Foreign Application Priority Data

Mar. 31, 2021 (JP) ..... 2021-061813

(51) Int. Cl.
*B63H 1/28* (2006.01)
*B63G 8/08* (2006.01)
*B63H 21/17* (2006.01)

(52) U.S. Cl.
CPC ..... *B63H 1/28* (2013.01); *B63G 8/08* (2013.01); *B63H 21/17* (2013.01)

(58) Field of Classification Search
CPC . B63H 1/28; B63H 21/17; B63H 5/14; B63G 8/08
(Continued)

(56) References Cited

U.S. PATENT DOCUMENTS 3,531,214 A 9/1970 Abramson
5,286,116 A 2/1994 Garis, Jr.
(Continued)

FOREIGN PATENT DOCUMENTS

CN 211370815 8/2020
CN 112061357 12/2020
(Continued)

OTHER PUBLICATIONS

U.S. Office Action issued Oct. 26, 2022 in U.S. Appl. No. 17/825,451.
(Continued)

*Primary Examiner* — Daniel V Venne
(74) *Attorney, Agent, or Firm* — Wenderoth, Lind & Ponack, L.L.P.

(57) ABSTRACT

A fluid machine includes: a shaft portion; a shroud having an inside surface with a diameter decreasing from an upstream side toward a downstream side, a flow path being formed between the shroud and the shaft portion and having a flow path cross-sectional area decreasing toward the downstream side; a propeller rotatably provided about an axis between the shaft portion and the shroud and configured to pump a fluid from the upstream side toward the downstream side; and a motor provided to correspond to the propeller and including a rotor having a ring-like shape fixed to an outer circumference portion of the propeller and accommodated in the shroud and a stator having a ring-like shape surrounding the rotor and fixed in the shroud, in which a plurality of the propellers are provided to be spaced apart in the axis direction, the motors are provided in an identical number to
(Continued)

the propellers to correspond to each of the propellers, and of a plurality of motors, the rotor of the motor positioned more on the downstream side has a smaller average outside diameter.

18 Claims, 13 Drawing Sheets

(58) Field of Classification Search
USPC ..... 114/312, 337, 338
See application file for complete search history.

(56) References Cited

U.S. PATENT DOCUMENTS

| | | | | |
|---|---|---|---|---|
| 5,289,068 | A | 2/1994 | Veronesi et al. | |
| 5,607,329 | A | 3/1997 | Cho et al. | |
| 5,795,076 | A | 8/1998 | Ball et al. | |
| 7,353,768 | B1 | 4/2008 | Jones et al. | |
| 8,074,592 | B2 | 12/2011 | Schröder | |
| 10,202,178 | B2 * | 2/2019 | Himmelmann | F42B 19/22 |
| 10,414,477 | B2 * | 9/2019 | Himmelmann | B60L 50/60 |
| 10,738,697 | B2 * | 8/2020 | Himmelmann | F02C 3/14 |
| 11,152,555 | B2 * | 10/2021 | Hiller | H10N 10/13 |
| 12,030,603 | B2 * | 7/2024 | Lautrup | B63G 8/08 |
| 2009/0293795 | A1 | 12/2009 | Schroder | |
| 2013/0115833 | A1 | 5/2013 | Suzuki et al. | |
| 2014/0356199 | A1 | 12/2014 | Varis et al. | |
| 2014/0368074 | A1 | 12/2014 | Tangudi | |
| 2017/0002857 | A1 | 1/2017 | Guest, Jr. | |
| 2017/0104385 | A1 | 4/2017 | Salamon et al. | |
| 2022/0315181 | A1 | 10/2022 | Senoo et al. | |
| 2022/0315183 | A1 | 10/2022 | Senoo et al. | |
| 2022/0315184 | A1 | 10/2022 | Senoo et al. | |
| 2022/0315185 | A1 | 10/2022 | Senoo et al. | |

FOREIGN PATENT DOCUMENTS

| | | |
|---|---|---|
| CN | 112874746 | 6/2021 |
| CN | 114056529 | 2/2022 |
| EP | 0425723 | 5/1991 |
| EP | 0566788 | 10/1993 |
| FR | 2927605 | 8/2009 |
| GB | 2593022 | 9/2021 |
| JP | 5-310185 | 11/1993 |
| JP | 5-310186 | 11/1993 |
| JP | 08-068599 | 3/1996 |
| JP | 10-257730 | 9/1998 |
| JP | 3346589 | 11/2002 |
| JP | 2004-168222 | 6/2004 |
| JP | 2013-100013 | 5/2013 |
| JP | 2017-109726 | 6/2017 |
| JP | 2018-519487 | 7/2018 |
| KR | 200477242 | 5/2015 |
| WO | 2004/113717 | 12/2004 |

OTHER PUBLICATIONS

U.S. Office Action issued Sep. 16, 2024 in U.S. Appl. No. 17/702,106.
U.S. Office Action issued Sep. 16, 2024 in U.S. Appl. No. 17/703,093.
Renilson, Martin; "Submarine Hydrodynamics", Springer International Publishing, 2015, ISSN 2191-5318, pp. 120-126.

* cited by examiner

FLUID MACHINE FOR UNDERWATER VEHICLE AND UNDERWATER VEHICLE

CROSS-REFERENCE TO RELATED APPLICATIONS

This application claims the benefit of priority to Japanese Patent Application Number 2021-061813 filed on Mar. 31, 2021. The entire contents of the above-identified application are hereby incorporated by reference.

TECHNICAL FIELD

The present disclosure relates to a fluid machine and an underwater vehicle.

RELATED ART

For example, an outer periphery driving propulsion apparatus is described in U.S. Pat. No. 8,074,592 as an example of a fluid machine. The propulsion apparatus includes a shroud having a tubular shape formed around the axis, and propellers coaxially arranged on the inner side of the shroud. Two propellers are arranged in the axis direction.

The shroud accommodates a total of two motors corresponding to the two respective propellers. Each motor includes a rotor provided on an outer circumference portion of the propeller and a stator surrounding the rotor from the outer circumference side. The motor and stator each have a tubular shape with the outside surface and the inside surface being parallel with the axis. Furthermore, the two motors are arranged side by side with their radial direction positions being the same.

Such motors implement outer periphery driving of the propellers, to make a fluid pumped in the axis direction inside the shroud.

SUMMARY

When a fluid is pumped by the propellers, the flow rate of the fluid increases, resulting in the flow of the fluid narrowed toward the inner side in the radial direction. In view of this, a flow path in which such a fluid flows preferably has a shape accordingly narrowed toward the downstream side, that is, the flow path has a flow path cross-sectional area decreasing toward the downstream side. However, the above-described propulsion apparatus described in U.S. Pat. No. 8,074,592 is configured to have the flow path cross-sectional area on the inner side of the shroud increasing toward the downstream side. Thus, the configuration is not preferable in terms of propeller efficiency.

When the outer periphery driving is implemented using a plurality of motors, the plurality of motors need to be arranged inside the shroud. Depending on the arrangement structure of the plurality of motors, the shroud might need to be upsized to enable the arrangement. The upsizing of the shroud, forming the outer shape of the propulsion apparatus, leads to an increase in the overall volume of the propulsion apparatus, and thus is not preferable.

The present disclosure is made to solve the problems described above, and an object of the present disclosure is to provide a fluid machine and an underwater vehicle that can be made compact with which improvement in efficiency as well can be achieved.

In order to solve the problems described above, a fluid machine according to the present disclosure includes: a shaft portion extending in an axis direction; a shroud provided to surround the shaft portion and having an inside surface with a diameter decreasing from an upstream side on one side in the axis direction toward a downstream side on another side in the axis direction, a flow path being formed between the shroud and the shaft portion and having a flow path cross-sectional area decreasing toward the downstream side; a propeller rotatably provided about an axis between the shaft portion and the shroud and configured to pump a fluid from the upstream side toward the downstream side; and a motor provided to correspond to the propeller and including a rotor having a ring-like shape fixed to an outer circumference portion of the propeller and accommodated in the shroud and a stator having a ring-like shape surrounding the rotor and fixed in the shroud, in which a plurality of the propellers are provided to be spaced apart in the axis direction, the motors are provided in an identical number to the propellers to correspond to each of the propellers, and of a plurality of motors, the rotor of the motor positioned more on the downstream side, has a smaller average outside diameter.

The present disclosure can provide a fluid machine and an underwater vehicle that can be made compact with which improvement in efficiency as well can be achieved.

BRIEF DESCRIPTION OF DRAWINGS

The disclosure will be described with reference to the accompanying drawings, wherein like numbers reference like elements.

DESCRIPTION OF EMBODIMENTS

<Overall Configuration of Underwater Vehicle>

Figure 1:
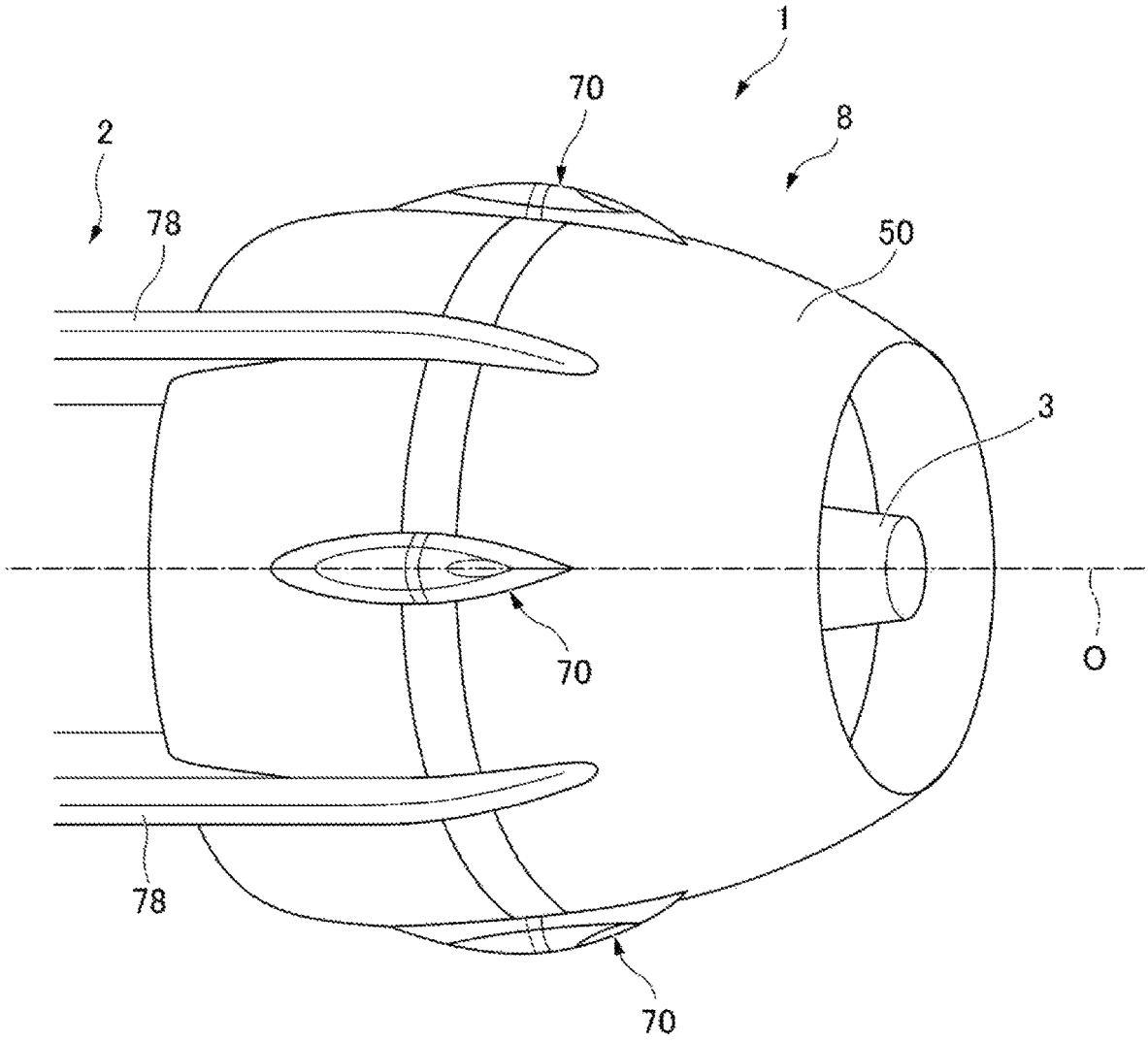
FIG. 1 is a perspective view of the stern of an underwater vehicle according to an embodiment of the present disclosure.
Figure 2:
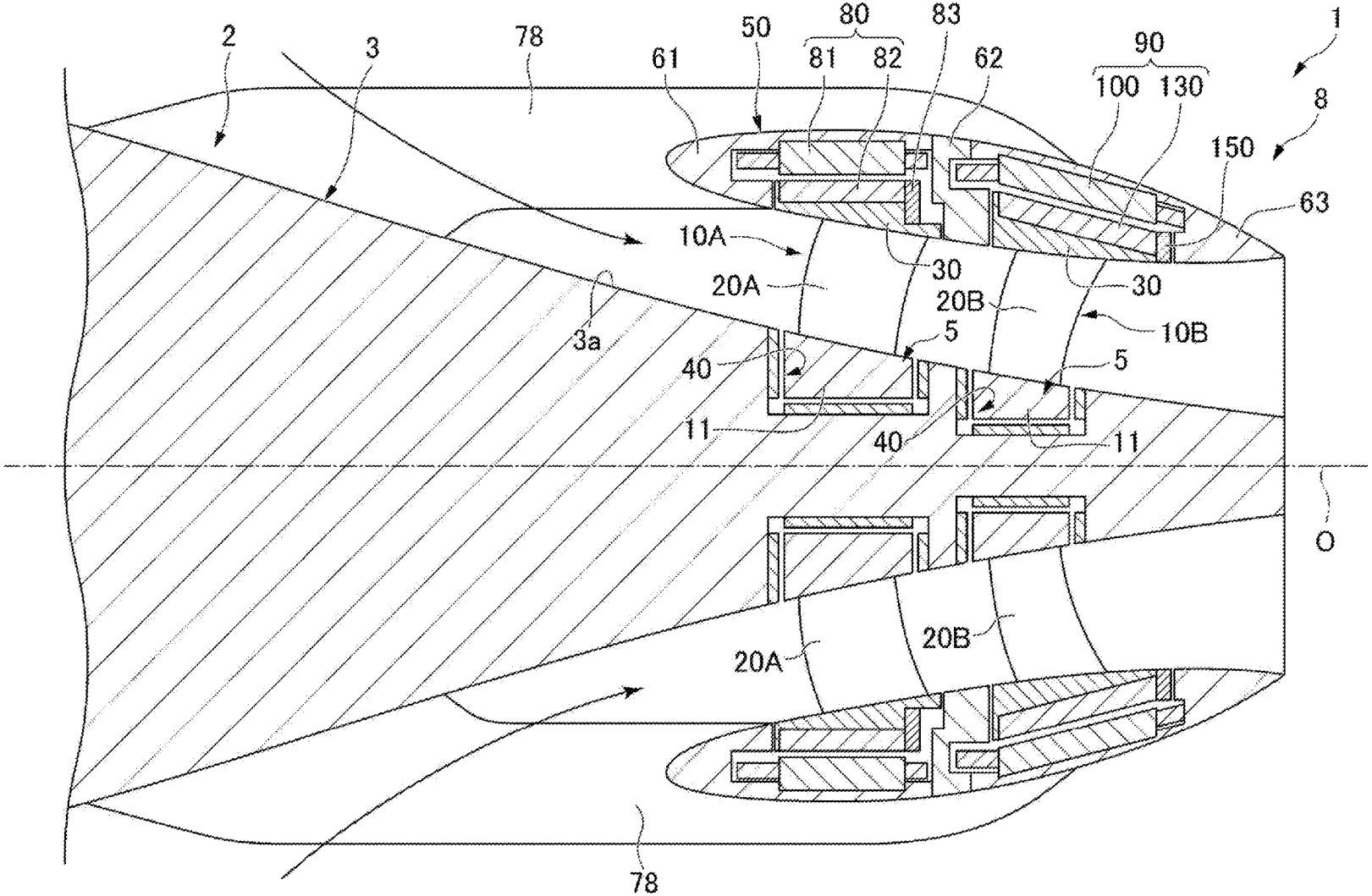
FIG. 2 is a vertical cross-sectional view of a propulsion apparatus according to the embodiment of the present disclosure.

The following describes in detail embodiments of the disclosure, with reference to the drawings. As illustrated in FIG. 1 and FIG. 2, an underwater vehicle 1 includes a vehicle body 2 and a propulsion apparatus 8.

<Vehicle Body>

The vehicle body 2 is formed by a pressure-resistant container that extends along an axis O. The vehicle body 2 accommodates various devices, power supply, communication equipment, sensors, and the like required for cruising underwater, for example.

<Propulsion Apparatus>

In a rear portion of the vehicle body 2, the propulsion apparatus 8 is provided integrally with the vehicle body 2. The propulsion apparatus 8 is an apparatus for propelling the underwater vehicle 1 underwater.

The propulsion apparatus 8 includes a shaft portion 3, a first propeller 10A, a second propeller 10B, bearing portions 40, a shroud 50, coupling portions 70, struts 78, a tubular motor 80, and a conical motor 90.

<Shaft Portion>

As illustrated in FIG. 2, the shaft portion 3 is integrally provided in the rear portion of the vehicle body 2. The shaft portion 3 may be part of the vehicle body 2. The shaft portion 3 has a rod shape extending along the axis O. The shaft portion 3 of the present embodiment has a truncated cone shape having a diameter decreasing from one side in the axis O direction (front side of the vehicle body 2) toward the other side in the axis O direction (rear side of the vehicle body 2). A surface of the shaft portion 3 facing an outer side in a radial direction is a shaft outside surface 3*a* forming a tapered shape having a diameter decreasing toward the other side in the axis O direction.

Receiving grooves 5 formed on the shaft portion 3 are recessed to an inner side in the radial direction from the shaft outside surface 3*a*, and annularly extend in a circumferential direction. Two receiving grooves 5 are formed at an interval in the axis O direction.

Figure 3:
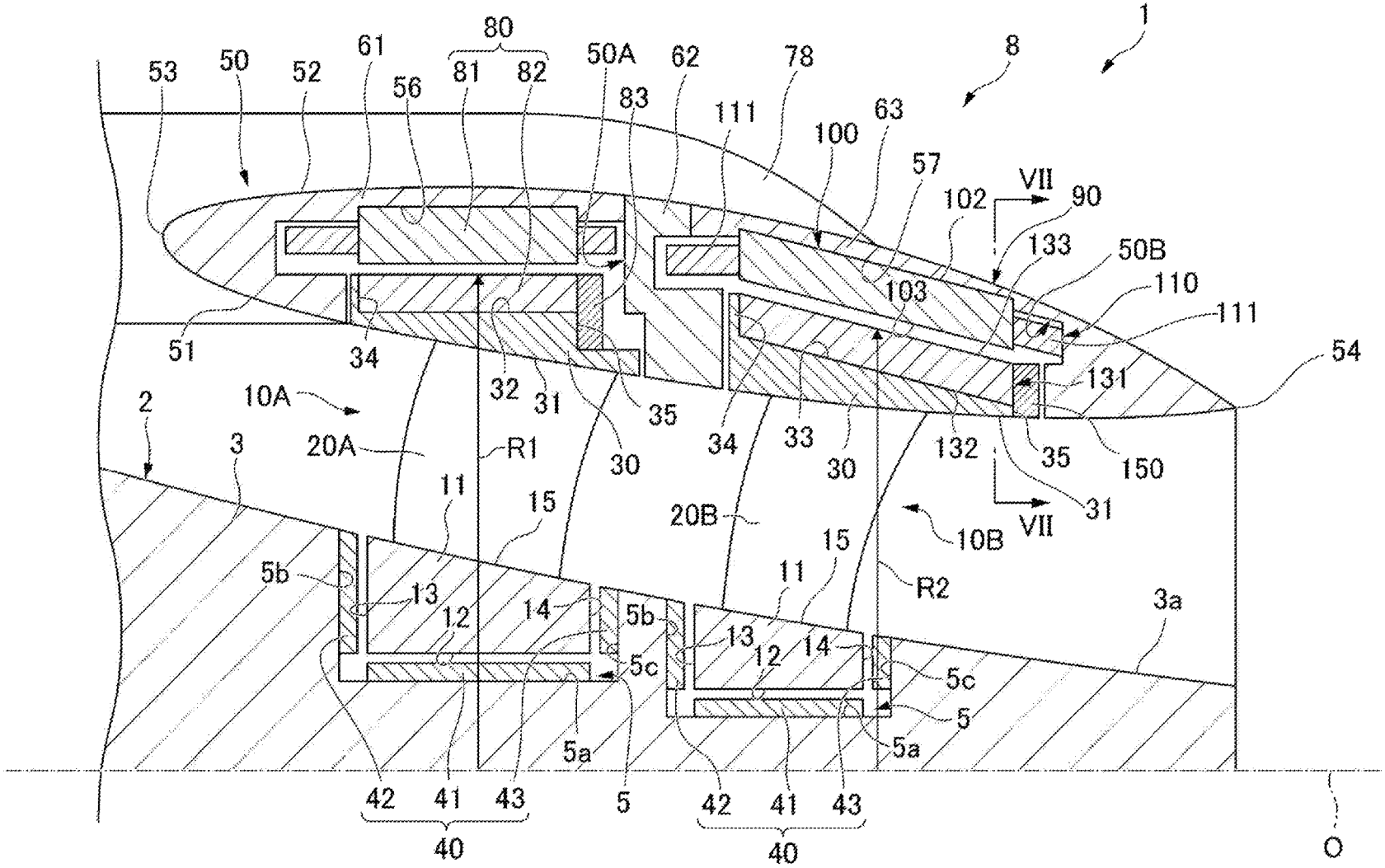
FIG. 3 is an enlarged view of a main part in FIG. 2.

Specifically, as illustrated in FIG. 3, a surface facing the outer side in the radial direction at the bottom of each receiving groove 5 is a groove bottom surface 5*a*. The groove bottom surface 5*a* forms a cylindrical shape around the axis O.

A surface, forming the receiving groove 5, on the one side in the axis O direction is a groove upstream side surface 5*b*. The groove upstream side surface 5*b* has a planar shape orthogonal to the axis O, and faces the other side in the axis O direction. The groove upstream side surface 5*b* annularly extends around the axis O.

A surface, forming the receiving groove 5, on the other side in the axis O direction is a groove downstream side surface 5*c*. The groove downstream side surface 5*c* has a planar shape orthogonal to the axis O, and faces the one side in the axis O direction. The groove downstream side surface 5*c* annularly extends around the axis O. The groove downstream side surface 5*c* is parallel to the groove upstream side surface 5*b*.

<First Propeller and Second Propeller>

As illustrated in FIG. 2 and FIG. 3, the first propeller 10A and the second propeller 10B are arranged on an outer circumference side of the shaft portion 3, and are relatively rotatable, about the axis O, with respect to the shaft portion 3. The first propeller 10A includes an inner circumference ring 11, a first blade 20A, and an outer circumference ring 30. The second propeller 10B includes an inner circumference ring 11, a second blade 20B, and an outer circumference ring 30.

<Inner Circumference Ring>

The inner circumference ring 11 is a member having a ring-like shape around the axis O. The inner circumference ring 11 of the first propeller 10A is received in the receiving groove 5 on the one side in the axis O direction. The inner circumference ring 11 of the second propeller 10B is received in the receiving groove 5 on the other side in the axis O direction.

As illustrated in FIG. 3, the inner circumference ring 11 includes a ring inner surface 12, an upstream end surface 13, a downstream end surface 14, and an outer circumference flow path surface 15.

The ring inner surface 12 forms an inside surface of the inner circumference ring 11. The ring inner surface 12 forms a cylindrical shape facing the groove bottom surface 5*a* entirely over the circumferential direction. The inside diameter of the ring inner surface 12 is set to be greater than the outside diameter of the groove bottom surface 5*a*.

The upstream end surface 13 is a surface of the inner circumference ring 11 facing the one side in the axis O direction, and is disposed on the other side of the groove upstream side surface 5*b* in the axis O direction with a space in between.

The downstream end surface 14 is a surface of the inner circumference ring 11 facing the other side in the axis O direction, and is disposed on the one side of the groove downstream side surface 5*c* in the axis O direction with a space in between.

The outer circumference flow path surface 15 forms an outside surface of the inner circumference ring 11 facing the outer side in the radial direction. The outer circumference flow path surface 15 forms a tapered shape with a diameter decreasing toward the other side in the axis O direction. The outer circumference flow path surface 15 extends to be continuous with the shaft outside surface 3*a*.

<First Blade 20A and Second Blade 20B>

The first blade 20A is provided to extend to the outer side in the radial direction from the outer circumference flow path surface 15 of the inner circumference ring 11 of the first propeller 10A. The second blade 20B is provided to extend to the outer side in the radial direction from the outer circumference flow path surface 15 of the inner circumference ring 11 of the second propeller 10B. A plurality of the first blades 20A and the second blades 20B are provided at an interval in the circumferential direction. The dimension of the first blade 20A and the second blade 20B in the axis O direction is smaller than the dimension of the inner circumference ring 11 in the axis O direction.

The cross-sectional shapes of the first blade 20A and the second blade 20B intersecting in the radial direction are of a blade form. Edge portions of the first blade 20A and the second blade 20B on the one side in the axis O direction are leading edges on an upstream side. Edge portions of the first blade 20A and the second blade 20B on the other side in the axis O direction are trailing edges on a downstream side. The one side and the other side in the axis O direction will be hereinafter respectively simply referred to as "upstream side" and "downstream side".

Figure 4A:
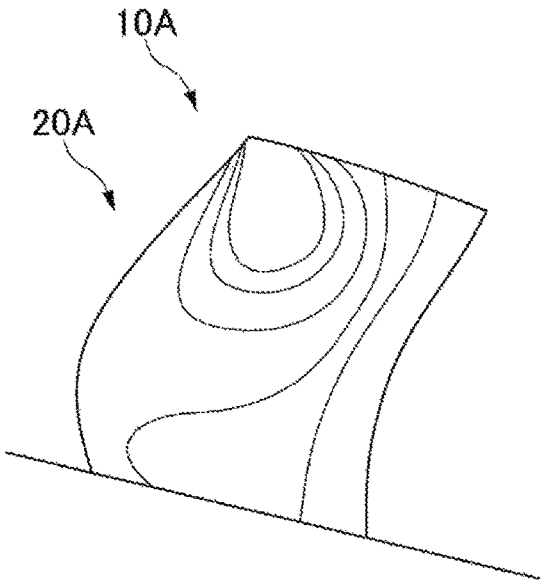
FIGS. 4A and 4B illustrate suction side pressure distributions of blades in propellers of the propulsion apparatus according to the embodiment, FIG. 4A being a drawing illustrating a suction side pressure distribution of a first blade, FIG. 4B being a drawing illustrating a suction side pressure distribution of a second blade.
Figure 4B:
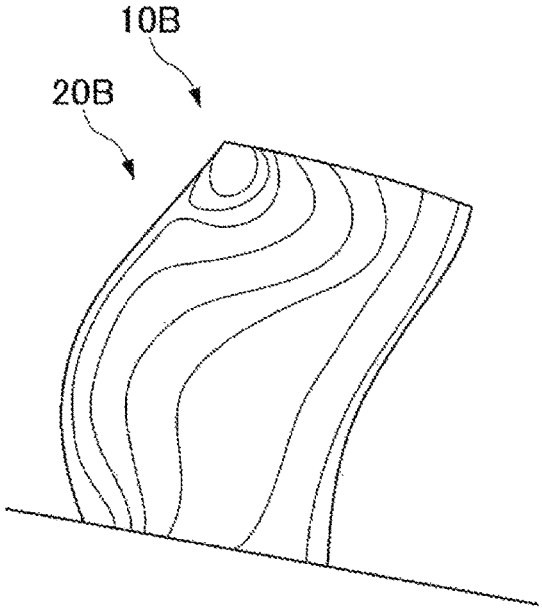

Now, the structure of the first blade 20A and the second blade 20B will be described in detail with reference to FIGS. 4A and 4B. FIGS. 4A and 4B illustrate pressure distributions on a suction side in a case where the first blade 20*a* and the second blade 20*b* rotate at a predetermined speed.

As illustrated in FIG. 4A, in the pressure distribution on the suction side of the first blade 20*a*, a region with the highest pressure, that is, a region with the largest load is formed on the leading edge side and the outer side in the radial direction. A portion on the inner side in the radial direction has no large load portion, and thus the load is low entirely over the portion in the axis O direction.

As illustrated in FIG. 4B, in the pressure distribution on the suction side of the second blade 20B, a region with the largest load is formed over the entirety of the leading edge in the radial direction. In particular, a portion on the leading edge side and on the outer side in the radial direction includes a locally large load portion.

As described above, the suction side pressure distribution of the second blade 20B is of a leading edge load type with the load concentrated on the leading edge. On the other hand, the suction side pressure distribution of the first blade 20A is of a balanced load type, with the load more distributed in the axis O direction, than in the suction side pressure distribution of the second blade 20B, with the load being smaller on the inner side in the radial direction.

<Outer Circumference Ring>

As illustrated in FIG. 2 and FIG. 3, the outer circumference ring 30 is a member forming an outer circumference portion of the first propeller 10A and the second propeller 10B, and has a ring-like shape around the axis O. The outer circumference ring 30 of the first propeller 10A establishes circumferential direction connection between the plurality of first blades 20A arranged in the circumferential direction. The outer circumference ring 30 of the second propeller 10B establishes circumferential direction connection between the plurality of second blades 20B arranged in the circumferential direction. The dimension of the outer circumference ring 30 of the first propeller 10A in the axis O direction is larger than the dimension of the first blade 20A in the axis O direction. The dimension of the outer circumference ring 30 of the second propeller 10B in the axis O direction is larger than the dimension of the second blade 20B in the axis O direction.

The outer circumference ring 30 of the first propeller 10A includes an inner circumference flow path surface 31, a cylindrical fix surface 32, a holding portion 34, and a downstream end surface 35. The outer circumference ring 30 of the second propeller 10B includes an inner circumference flow path surface 31, a tapered fix surface 33, a holding portion 34, and a downstream end surface 35.

The inner circumference flow path surface 31 is a surface forming the inside surface of each outer circumference ring 30. The inner circumference flow path surface 31 of the outer circumference ring 30 of the first propeller 10A is integrally connected to end portions of the plurality of first blade 20A arranged in the circumferential direction, on the outer side in the radial direction. The inner circumference flow path surface 31 of the outer circumference ring 30 of the second propeller 10B is integrally connected to end portions of the plurality of second blade 20B arranged in the circumferential direction, on the outer side in the radial direction.

The cylindrical fix surface 32 is a surface forming the outside surface of the outer circumference ring 30 of the first propeller 10A. The cylindrical fix surface 32 forms a cylindrical shape around the axis O, and extends in the axis O direction. The cylindrical fix surface 32 is parallel to the axis O.

The tapered fix surface 33 is a surface forming the outside surface of the outer circumference ring 30 of the second propeller 10B. The tapered fix surface 33 forms a tapered shape with a diameter decreasing toward the downstream side. The tapered fix surface 33 has a uniform taper angle, and thus extends in the axis O direction with a uniform inclination angle relative to the axis O. With such a tapered fix surface 33 provided, the thickness of the outer circumference ring 30 of the second propeller 10B in the radial direction decreases toward the downstream side.

An average outside diameter of the tapered fix surface 33 is set to be smaller than the average outside diameter of the cylindrical fix surface 32. In the present embodiment, the tapered fix surface 33 extends to be in a uniform tapered shape in the axis O direction. Thus, the average outside diameter of the tapered fix surface 33 is the same as the outside diameter of the tapered fix surface 33 at the center in the axis O direction. The average outside diameter of the cylindrical fix surface 32 is the same as the outside diameter of any portion of the cylindrical fix surface 32 in the axis O direction.

In the present embodiment, the outside diameter of the end portion of the tapered fix surface 33 on the upstream side is set to be the same as the outside diameter of the end portion of the cylindrical fix surface 32 on the downstream side, or to be smaller than the outside diameter of the end portion of the cylindrical fix surface 32 on the downstream side.

The holding portion 34 protrudes to the outer side in the radial direction from each of the end portion of the cylindrical fix surface 32 on the upstream side and the end portion of the tapered fix surface 33 on the upstream side in each outer circumference ring 30, and entirely extends in the circumferential direction.

<Bearing Portions>

The bearing portions 40 support the first propeller 10A and the second propeller 10B to be rotatable relative to the shaft portion 3. The bearing portions 40 are provided in the respective receiving grooves 5 and rotatably supports the inner circumference rings 11 of the first propeller 10A and the second propeller 10B. The bearing portions 40 each include a radial bearing 41, an upstream side thrust bearing 42, and a downstream side thrust bearing 43.

The radial bearing 41 is provided on the groove bottom surface 5*a* of the receiving groove 5 entirely over the circumferential direction. In the present embodiment, a journal bearing is used as the radial bearing 41. The outside diameter of the journal bearing is smaller than the inside diameter of the inner circumference ring 11. Thus, a clearance is formed entirely over the circumferential direction between the journal bearing and the inner circumference ring 11.

The upstream side thrust bearing 42 is provided on the groove upstream side surface 5*b* of the receiving groove 5 entirely over the circumferential direction. The upstream side thrust bearing 42 faces the upstream end surface 13 of the inner circumference ring 11 in the axis O direction, across the clearance.

The downstream side thrust bearing 43 is provided on the groove downstream side surface 5*c* of the receiving groove 5 entirely over the circumferential direction. The downstream side thrust bearing 43 faces the downstream end surface 14 of the inner circumference ring 11 in the axis O direction, across the clearance.

Water flowing into the receiving groove 5 is provided between the radial bearing 41, the upstream side thrust bearing 42, and the downstream side thrust bearing 43 and the inner circumference ring 11. Thus, the radial bearing 41, the upstream side thrust bearing 42, and the downstream side thrust bearing 43 rotatably support the inner circumference ring 11, with a water film formed between the bearings and the inner circumference ring 11.

<Shroud>

The shroud 50 is provided to surround the shaft portion 3, the first propeller 10A, and the second propeller 10B from the outer circumference side. The shroud 50 forms an annular shape around the axis O. The shroud 50 is disposed with a space from the outside surface of the shaft portion 3 in the radial direction. Thus, an annular flow path is formed entirely over the axis O direction between the shroud 50 and the shaft portion 3. The first blades 20A of the first propeller 10A and the second blades 20B of the second propeller 10B are positioned in the flow path, and the outer circumference rings 30 of the first propeller 10A and the second propeller 10B are accommodated in the shroud 50.

The surface of the shroud 50 facing the inner side in the radial direction is a shroud inside surface 51. The shroud inside surface 51 faces the flow path. The surface of the shroud 50 facing the outer side in the radial direction is a shroud outside surface 52.

The cross-sectional shape of the shroud 50 of the present embodiment, including the axis O, is of a blade form. A connection portion between end portions of the shroud inside surface 51 and the shroud outside surface 52 on the upstream side is a shroud leading edge 53 annularly extending over the circumferential direction. A connection portion at end portions of the shroud inside surface 51 and the shroud outside surface 52 on the downstream side is a shroud trailing edge 54 extending over the circumferential direction and forming an annular shape. The position of the shroud trailing edge 54 in the axis O direction is the same as the position of the rear end of the shaft portion 3 in the axis O direction.

The shroud 50 has a shape with the diameter gradually decreasing toward the downstream side from the upstream side. In the present embodiment, a camber line, in the blade form cross section of the shroud 50, the distances of which from the shroud inside surface 51 and the shroud outside surface 52 are the same, is gradually inclined to the inner side in the radial direction toward the downstream side from the upstream side. Thus, the shroud trailing edge 54 is positioned more on the inner side than the shroud leading edge 53 in the radial direction.

The shroud outside surface 52 has a diameter first increasing toward the downstream side in a portion around the shroud leading edge 53, and then smoothly decreasing toward the downstream side. The shroud outside surface 52 forms a convex curved shape protruding toward the outer side in the radial direction.

The shroud inside surface 51 has a diameter decreasing on the inner side in the radial direction toward the downstream side, entirely over the axis O direction. The shroud inside surface 51 forms a convex curved shape protruding toward the inner side in the radial direction. The annular flow path formed between the shroud inside surface 51 and the shaft outside surface 3*a* of the shaft portion 3 is narrowed on the inner side in the radial direction toward the downstream side. Thus, the flow path cross-sectional area of the flow path decreases toward the downstream side.

The shroud inside surface 51 does not need to have the diameter decreasing over the entire section from the shroud leading edge 53 to the shroud trailing edge 54. It suffices if the diameter decreases from the shroud leading edge 53 to at least the position of the trailing edge of the second blade 20B of the second propeller 10B in the axis O direction.

Thus, the flow path cross-sectional area of the flow path formed by the shroud inside surface 51 and the shaft outside surface 3*a* does not need to have the diameter gradually decreasing over the entirety of the shroud 50 in the axis O direction. It suffices if the diameter gradually decreases from the shroud leading edge 53 to at least the position of the trailing edge of the second blade 20B of the second propeller 10B in the axis O direction.

A first cavity 50A and a second cavity 50B that are recessed to the outer side in the radial direction from the shroud inside surface 51 are formed in the shroud 50. The first cavity 50A is formed in a portion on the upstream side in the shroud 50, whereas the second cavity 50B is formed in a portion on the downstream side in the shroud 50. Thus, the second cavity 50B is formed more on the downstream side than the first cavity 50A.

The outer circumference ring 30 of the first propeller 10A is accommodated in the first cavity 50A. The outer circumference ring 30 of the second propeller 10B is accommodated in the second cavity 50B. The inner circumference flow path surface 31 of each outer circumference ring 30 extends to be continuous with the shroud inside surface 51 in the axis O direction. In other words, the inner circumference flow path surface 31 extends to form a part of the convex curved surface of the shroud inside surface 51.

On a surface in the first cavity 50A facing the inner side in the radial direction, a cylindrical fix recess portion 56 having a bottom portion and forming a cylindrical shape around the axis O is formed. The cylindrical fix recess portion 56 is formed at a position in the outer circumference ring 30 of the first propeller 10A, corresponding to the cylindrical fix surface 32 in the axis O direction.

On a surface in the second cavity 50B facing the inner side in the radial direction, a tapered fix recess portion 57 having a bottom portion and having a diameter decreasing toward the downstream side with a uniform taper angle is formed. The tapered fix recess portion 57 is formed at a position in the outer circumference ring 30 of the second propeller 10B, corresponding to the tapered fix surface 33 in the axis O direction.

The average inside diameter of the bottom portion of the tapered fix recess portion 57 is set to be smaller than the average inside diameter of the bottom portion of the cylindrical fix recess portion 56. The bottom portion of the tapered fix recess portion 57 extends in the axis O direction with a uniform taper angle. Thus, the average inside diameter of the bottom portion of the tapered fix recess portion 57 matches the inside diameter of the bottom portion of the tapered fix recess portion 57 at the center in the axis O direction. The bottom portion of the cylindrical fix recess portion 56 forms a cylindrical shape parallel to the axis O direction, and thus the average inside diameter of the cylindrical fix recess portion 56 is the same as the inside diameter of any portion of the bottom portion of the cylindrical fix recess portion 56 in the axis O direction.

Note that "average inside diameter" means the average inside diameter in the axis O direction.

The shroud 50 of the present embodiment is formed by coupling a plurality of segments, split in the axis O direction. Specifically, the shroud 50 includes, as the segments, an upstream segment 61, an intermediate segment 62, and a downstream segment 63.

The upstream segment 61 forms a portion on the upstream side including the shroud leading edge 53.

The intermediate segment 62 forms a portion continuous to the downstream side of the upstream segment 61 of the shroud 50. The first cavity 50A is defined and formed by the intermediate segment 62 closing, from the downstream side, a largely notched part of the upstream segment 61 on the inner side in the radial direction and on the downstream side.

The downstream segment 63 forms a portion that is continuous to the downstream side of the intermediate segment 62, and forms a portion including the shroud trailing edge 54. The second cavity 50B is defined and formed by intermediate segment 62 closing, from the upstream side, a largely notched part of the downstream segment 63 on the inner side in the radial direction and on the upstream side.

<Coupling Portions>

As illustrated in FIG. 1, the coupling portions 70 are provided to protrude from the shroud outside surface 52 of the shroud 50. The coupling portions 70 couple the plurality of segments of the shroud 50 to each other.

Figure 5:
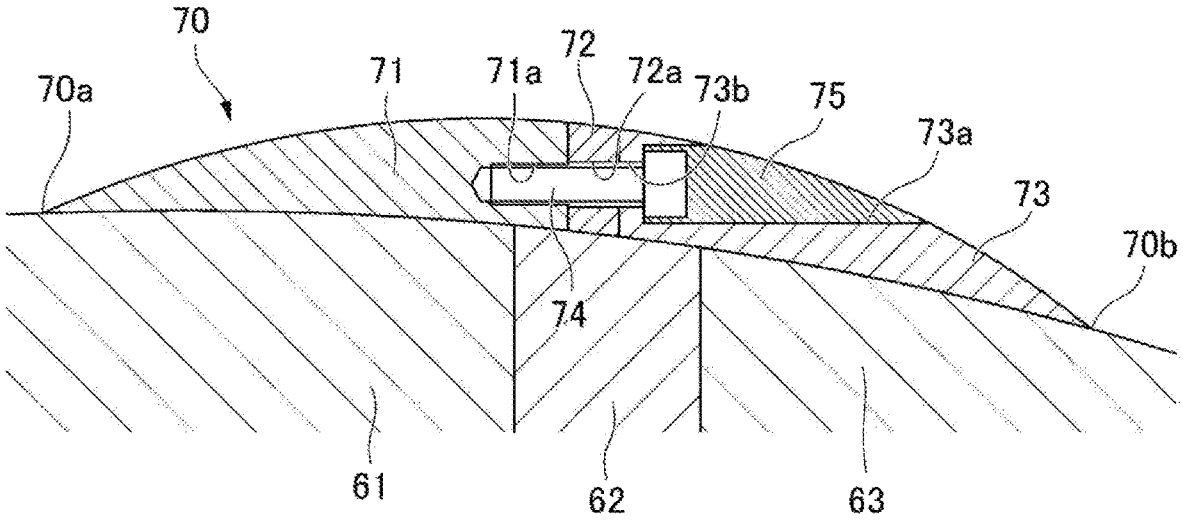
FIG. 5 is a vertical cross-sectional view of a coupling portion disposed on an outside surface of a shroud.

As illustrated in detail in FIG. 5, the coupling portions 70 each include an upstream protruding portion 71, an intermediate protruding portion 72, a downstream protruding portion 73, a coupling bolt 74, and a filling portion 75.

The upstream protruding portion 71 is integrally provided to the upstream segment 61 of the shroud 50, and protrudes from the outside surface of the upstream segment 61. A bolt fix hole 71*a* is formed, in the upstream protruding portion 71, as a recess from the downstream side toward the upstream side.

The intermediate protruding portion 72 is integrally provided to the intermediate segment 62 of the shroud 50, and protrudes from the outside surface of the intermediate segment 62. A bolt through-hole 72*a* is formed through the intermediate protruding portion 72 in the axis O direction.

The downstream protruding portion 73 is integrally provided to the downstream segment 63 of the shroud 50, and protrudes from the outside surface of the downstream segment 63. A bolt recess portion 73*a* is formed in the downstream protruding portion 73 as a recess from the downstream side toward the upstream side. In the bottom portion of the bolt recess portion 73*a*, a bolt insertion hole 73*b* is formed that penetrates the bottom portion and the surface of the downstream protruding portion 73 facing the upstream side.

The coupling bolt 74 couples the upstream protruding portion 71, the intermediate protruding portion 72, and the downstream protruding portion 73 to each other. When the upstream segment 61, the intermediate segment 62, and the downstream segment 63 are coupled to each other by the coupling portion 70, the upstream protruding portion 71, the intermediate protruding portion 72, and the downstream protruding portion 73 are positioned in this order from the upstream side to the downstream side, to sequentially come into contact with each other. In this state, the bolt insertion hole 73*b*, the bolt through-hole 72*a*, and the bolt fix hole 71*a* are in communication with each other in the axis O direction. The coupling bolt 74 is inserted and fixed in the bolt insertion hole 73*b*, the bolt through-hole 72*a*, and the bolt fix hole 71*a* thus in communication with each other, via the bolt recess portion 73*a*. As a result, the upstream protruding portion 71, the intermediate protruding portion 72, and the downstream protruding portion 73 are integrally coupled to each other, and the upstream segment 61, the intermediate segment 62, and the downstream segment 63 respectively integrated with the upstream protruding portion 71, the intermediate protruding portion 72, and the downstream protruding portion 73 are integrally coupled to each other in the axis O direction.

The filling portion 75 is provided to fill the bolt recess portion 73*a*. The filling portion 75 is cured resin for example. The filling portion 75 is formed when resin in a liquid form is poured into the bolt recess portion 73*a* after the coupling bolt 74 is attached and the resin is cured. A part of the filling portion 75 forms the outer surface of the coupling portion 70.

Now the outer surface shape of the coupling portion 70 as described above will be described with reference to FIG. 5 and FIG. 6. The outer surface shape of the coupling portion 70 is formed by the upstream protruding portion 71, the intermediate protruding portion 72, and the downstream protruding portion 73, as well as the surface of the filling portion 75 exposed from the bolt recess portion 73*a*. The coupling portion 70 as a whole forms a convex curved shape protruding from the shroud outside surface 52. The coupling portion 70 forms a convex curved shape with a longitudinal direction matching the axis O direction.

Figure 6:
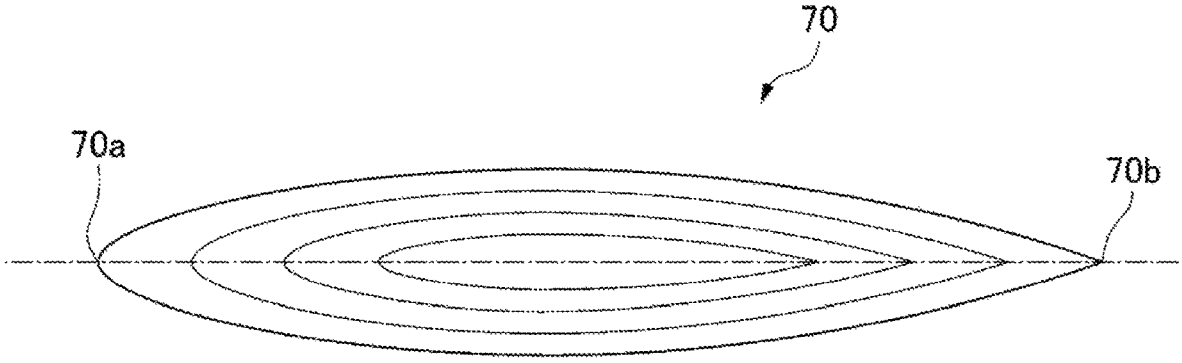
FIG. 6 is a schematic view of the coupling portion disposed on the outside surface of the shroud as viewed from an outer side in a radial direction.

Furthermore, as illustrated in FIG. 6, the coupling portion 70 of the present embodiment has a cross-sectional shape, along the shroud outside surface 52, of a blade form with the upstream side corresponding to the leading edge and the downstream side corresponding to the trailing edge. The leading edge of the coupling portion 70 is a protruding portion leading edge 70*a*. The trailing edge of the coupling portion 70 is a protruding portion trailing edge 70*b*. More specifically, the coupling portion 70 has a shape obtained by stacking blade forms in the normal direction with similar shapes and sizes gradually decreasing as they get further in the normal direction of the shroud outside surface 52.

<Struts>

As illustrated in FIG. 1 and FIG. 2, the struts 78 support the shroud 50 with respect to the shaft portion 3, by coupling the shroud 50 and the shaft portion 3 to each other. A plurality of the struts 78 are provided at an interval in the circumferential direction, and extend in the axis O direction. The downstream side end portion of each strut 78 is fixed to the shroud 50. The upstream side end portion of the strut 78 is fixed to the shaft outside surface 3*a* of the shaft portion 3.

The cross-sectional shape of the strut 78 orthogonal to the axis O is a flat rectangular shape with the longitudinal direction matching the radial direction and the shorter direction matching the circumferential direction. Thus, the rotation of the propulsion of the underwater vehicle 1 is suppressed.

<Tubular Motor>

As illustrated in FIG. 2 and FIG. 3, the tubular motor 80 is accommodated in the first cavity 50A of the shroud 50. The tubular motor 80 rotationally drives the first propeller 10A. The tubular motor 80 includes a tubular stator 81 and a tubular rotor 82.

The tubular stator 81 forms a tubular shape around the axis O, extending in the axis O direction. The inside surface and the outside surface of the tubular stator 81 are parallel to the axis O. The tubular stator 81 has the outside surface fitted to the cylindrical fix recess portion 56 in the first cavity 50A of the shroud 50. Thus, the tubular motor 80 is integrally fixed to the shroud 50. The outside diameter of the outside surface of the tubular stator 81 is the same as the inside diameter of the bottom surface of the cylindrical fix recess portion 56 entirely over the axis O direction.

The tubular rotor 82 forms a tubular shape around the axis O, extending in the axis O direction. The inside surface and the outside surface of the tubular rotor 82 are parallel to the axis O. The outside diameter of the tubular rotor 82 is set to be smaller than the inside diameter of the tubular stator 81. The dimension of the tubular rotor 82 in the axis O direction is the same as that of the tubular stator 81. The tubular rotor 82 is integrally fixed to the cylindrical fix surface 32 of the first propeller 10A from the outer circumference side. Thus, the inside diameter of the tubular rotor 82 and the outside diameter of the cylindrical fix surface 32 are the same entirely over the axis O direction. The outside surface of the tubular rotor 82 faces the inside surface of the tubular stator 81 entirely over the circumferential direction and the axis O direction. A clearance is formed entirely over the circumferential direction and the axis O direction, between the outside surface of the tubular rotor 82 and the inside surface of the tubular stator 81.

The upstream side end surface of the tubular rotor 82 is in contact with the holding portion 34 in the outer circumference ring 30 of the first propeller 10A, from the downstream side.

A first holding plate 83 is in contact with the downstream side end surface of the tubular rotor 82. The first holding plate 83 is provided over the entirety between the downstream side end surface of the tubular rotor 82 and the downstream end surface 35 of the outer circumference ring 30 of the first propeller 10A. With the first holding plate 83 fixed to the outer circumference ring 30 using a bolt not illustrated, the tubular rotor 82 is fixed by the first holding plate 83 from the downstream side.

In the tubular motor 80, when the tubular stator 81 is energized, a rotating magnetic field is generated, whereby the tubular rotor 82 rotates about the axis O.

<Conical Motor>

As illustrated in FIG. 2 and FIG. 3, the conical motor 90 is accommodated in the second cavity 50B of the shroud 50. The conical motor 90 drives the second propeller 10B. The conical motor 90 includes a conical stator 100 and a conical rotor 130.

<Conical Stator>

Figure 7:
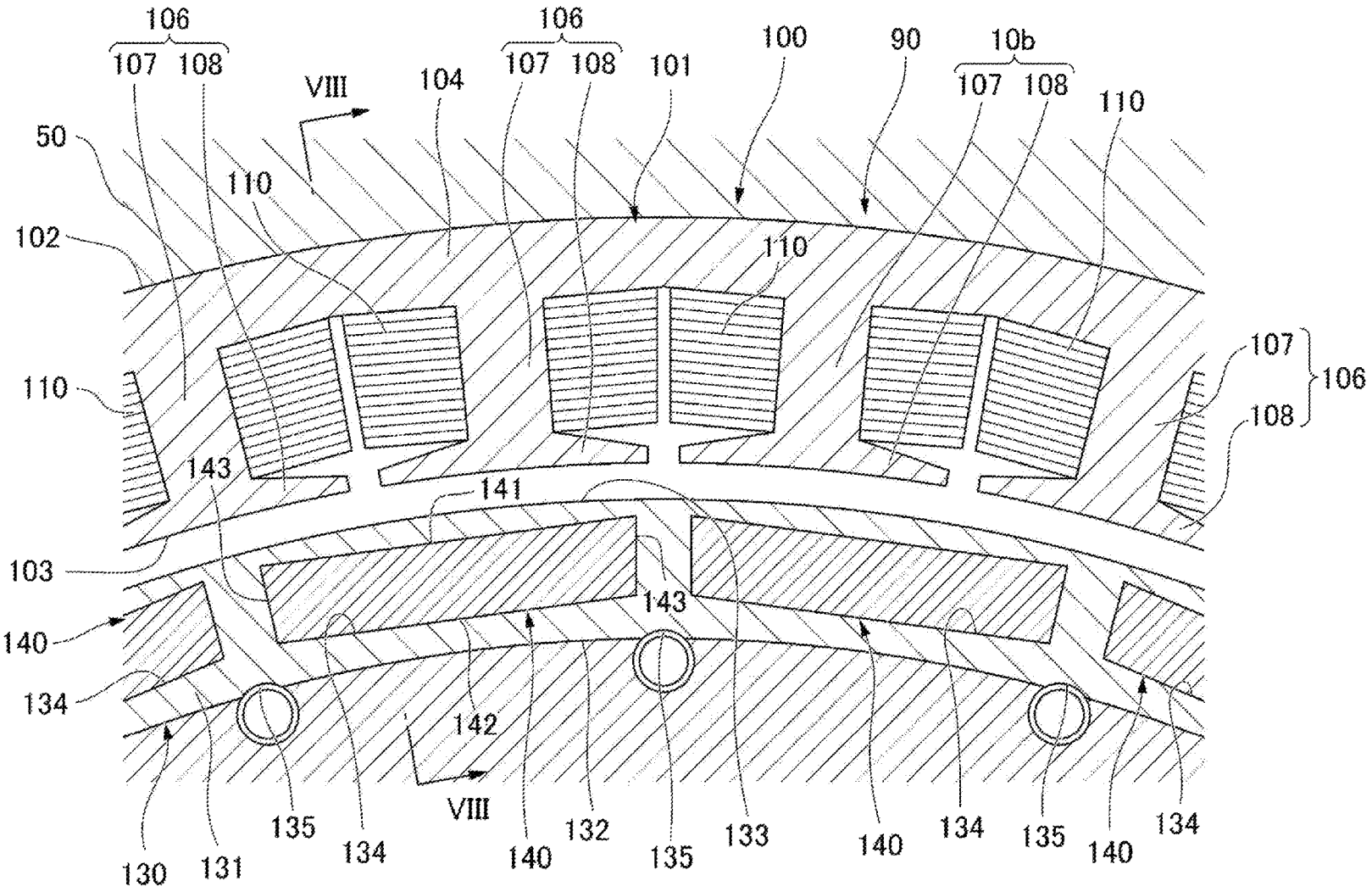
FIG. 7 is a cross-sectional view orthogonal to an axis of a conical motor, taken along line VII-VII in FIG. 3.
Figure 8:
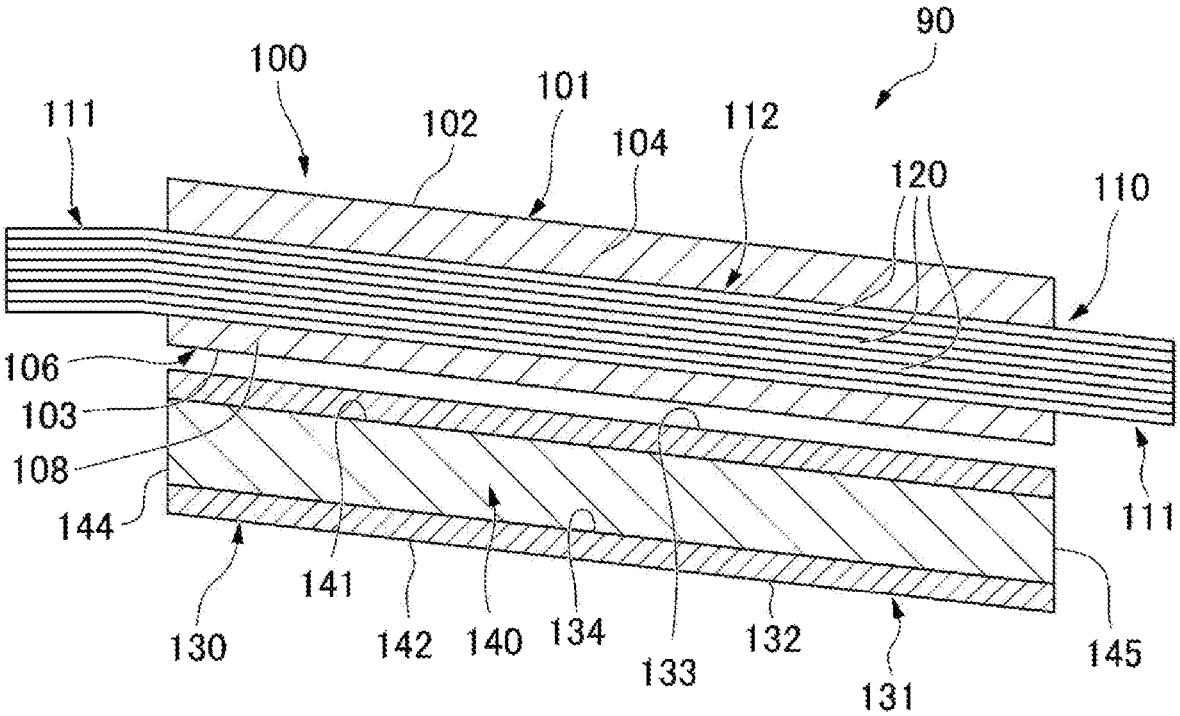
FIG. 8 is a vertical cross-sectional view including the axis of the conical motor, taken along line VIII-VIII in FIG. 7.

As illustrated in FIG. 2 and FIG. 3, the conical stator 100 is fixed in the second cavity 50B of the shroud 50. As illustrated in FIG. 7 and FIG. 8, the conical stator 100 includes a stator core 101 and coils 110.

<Stator Core>

The stator core 101 includes a back yoke 104 forming an annular shape around the axis O, and teeth 106 protruding from the inside surface of the back yoke 104.

The back yoke 104 has an inside surface and an outside surface forming a tapered shape inclined to the inner side in the radial direction, toward the downstream side. Thus, the back yoke 104 as a whole has a shape with a diameter decreasing toward the downstream side. The thickness of the back yoke 104 in the radial direction is constant entirely over the axis O direction and the circumferential direction. The outside surface of the back yoke 104 is a stator outside surface 102. The stator outside surface 102 is fitted and fixed to the tapered fix recess portion 57 in the second cavity 50B of the shroud 50 as illustrated in FIG. 3. Thus, the conical stator 100 is integrally fixed in the second cavity 50B of the shroud 50. The taper angle of the stator outside surface 102 that is the outside surface of the back yoke 104 and the taper angle of the bottom surface of the tapered fix recess portion 57 are set to be the same. The outside diameter of the stator outside surface 102 and the inside diameter of the bottom portion of the tapered fix recess portion 57 are the same at any position in the axis O direction, and thus are the same entirely over the axis O direction.

<Teeth>

As illustrated in FIG. 7, a plurality of the teeth 106 are provided at an interval in the circumferential direction on the inner circumference side of the back yoke 104. The teeth 106 each include: a teeth body 107 that is connected to the back yoke 104 and extending in the radial direction; and a teeth distal end portion 108 that is a portion provided to an end portion of the teeth body 107 on the inner side in the radial direction and expanding toward both sides in the circumferential direction from the teeth body 107.

As illustrated in FIG. 8, the protrusion heights of the teeth 106 from the inside surface of the back yoke 104 are constant in the axis O direction. Thus, a stator inside surface 103 that is an end portion of the teeth 106 on the inner side in the radial direction is inclined to the inner side in the radial direction toward the downstream side. In other words, the stator inside surface 103 has a diameter decreasing toward the downstream side. A space between adjacent ones of the teeth 106 serves as a slot accommodating the coil 110.

The taper angles of the stator inside surface 103 and the stator outside surface 102 are the same and constant entirely over the axis O direction. Thus, in the cross section including the axis O, the stator inside surface 103 and the stator outside surface 102 are parallel to each other.

The teeth 106 are configured to have a thickness, in the circumferential direction, decreasing toward the downstream side. Thus, the plurality of teeth 106 can be arranged without interfering with the inner side of the back yoke 104 having the diameter decreasing toward the downstream side.

<Coils>

A plurality of the coils 110 are provided to surround the respective teeth bodies 107 extending in the radial direction. Each coil 110 is formed by stacking a plurality of coil layers 120 illustrated in FIG. 9 in the radial direction. With each coil layer 120 surrounding the outer surface of the teeth body 107, the coil as a whole is provided to the outer surface of the teeth body 107.

Each coil layer 120 is formed by a rectangular copper wire. The cross-sectional shape of the rectangular copper wire is a shape squashed in an extending direction of the teeth body 107, and thus is a flat shape with the shorter direction matching the radial direction.

Figure 9:
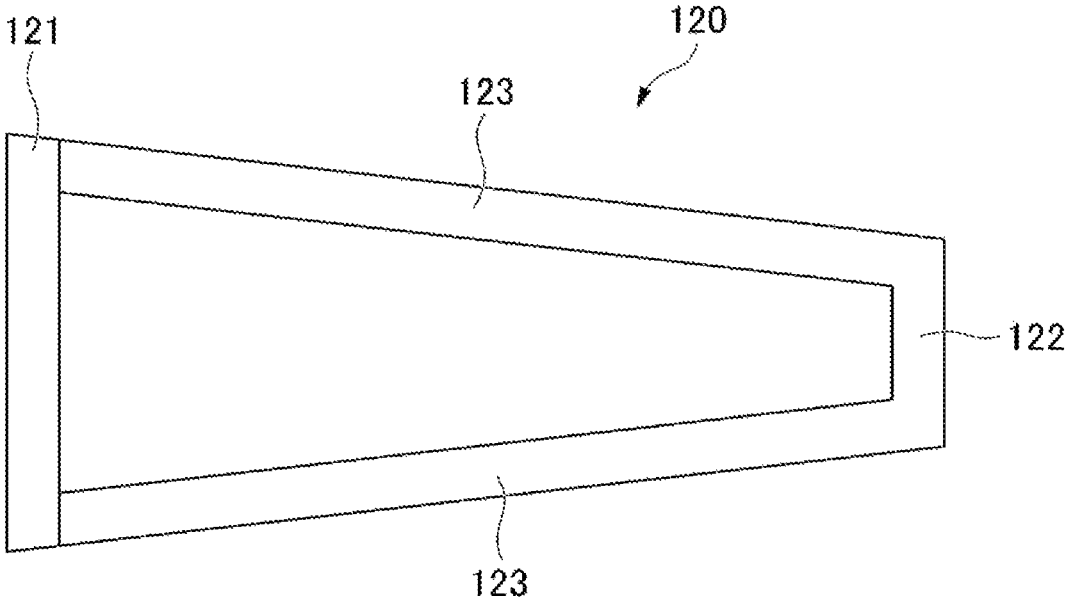
FIG. 9 is a view of a coil layer forming a coil of the conical motor, viewed from the outer side in the radial direction.

The coil layer 120 has a rectangular annular shape surrounding the teeth body 107 as illustrated in FIG. 9, in accordance with the cross-sectional shape of the teeth body 107 orthogonal to the radial direction. A portion of the coil layer 120 extending in the circumferential direction on the upstream side is an upstream piece 121 that comes into contact with the teeth body 107 from the upstream side.

A portion of the coil layer 120 extending in the circumferential direction on the downstream side is a downstream piece 122 that comes into contact with the teeth body 107 from the downstream side. The dimension of the downstream piece 122 in the circumferential direction is shorter than the dimension of the upstream piece 121 in the circumferential direction.

A pair of portions of the coil layer 120 extending in the axis O direction on both sides of the teeth 106 in the circumferential direction are each a side piece 123. The pair of side pieces 123 are in contact with the teeth 106 from both sides in the circumferential direction, and extend to be closer to each other toward the downstream side.

Each coil 110 forms spiral shaped winding around the teeth body 107, with the plurality of coil layers 120 electrically connected to each other and being stacked in the radial direction.

As illustrated in FIG. 8, portions of the coil 110, provided around the teeth 106, at both ends in the axis O direction, that is, portions respectively protruding on the upstream side and the downstream side from the teeth 106 are coil ends 111. A portion of the coil 110 excluding the coil ends 111, that is, a portion in contact with the teeth 106 from both sides in the circumferential direction is a coil main portion 112.

In the present embodiment, as illustrated in FIG. 8, portions of the coil 110 forming the coil main portion 112 and the coil end 111 on the downstream side extend to be inclined to the inner side in the radial direction toward the downstream side. Thus, the side pieces 123 and the downstream piece 122 of each coil layer 120 are arranged to be inclined to the inner side in the radial direction toward the downstream side.

On the other hand, the portion of the coil 110 forming the coil end 111 on the upstream side is bent relative to the coil main portion 112 to extend in parallel with the axis O direction. In other words, the upstream piece 121 of each coil layer 120 is bent relative to the pair of side pieces 123 of the coil layer 120 to extend in parallel with the axis O.

In the present embodiment, the axis O direction positions of the downstream side end portions of the coil layers 120 are the same among the coil layers 120. The axis O direction positions of the upstream side end portions of the coil layers 120 are the same among the coil layers 120. The end portions of the coil ends 111 in the axis O direction are arranged to have the axis O direction positions being the same among the coil layers 120.

<Conical Rotor>

Figure 10:
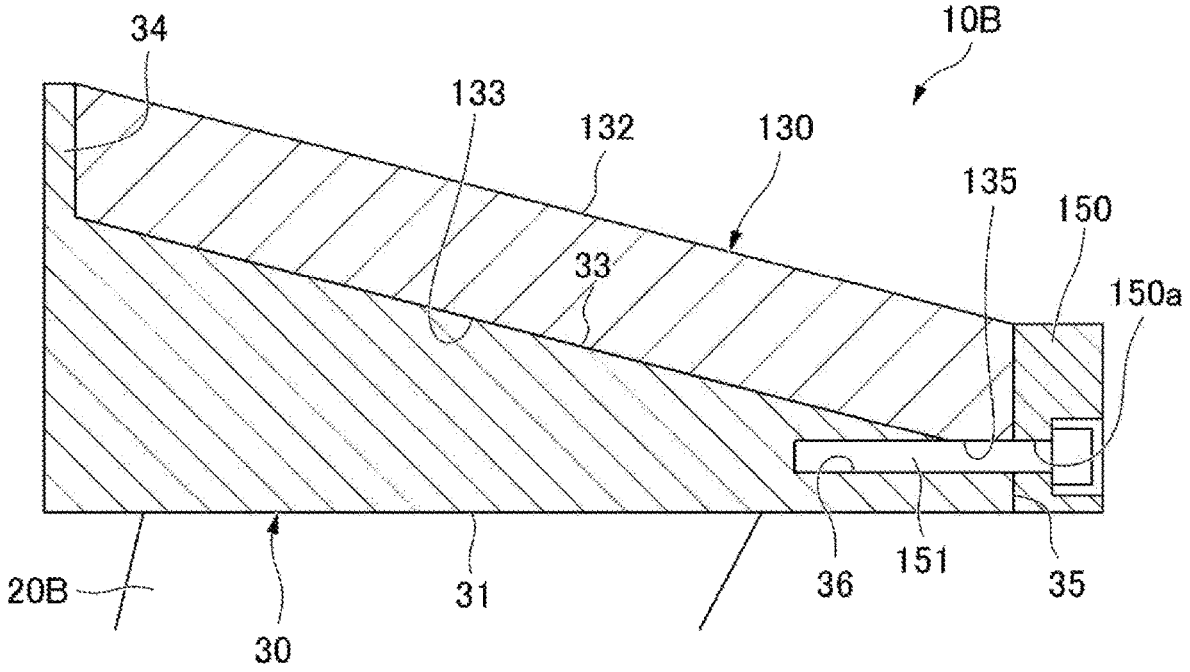
FIG. 10 is a partially enlarged view of FIG. 3 for illustrating the attachment structure of a conical stator to an outer circumference ring.

As illustrated in FIG. 2 and FIG. 3, and illustrated in detail in FIG. 10, the conical rotor 130 is fixed to the outer circumference side of the outer circumference ring 30 of the second propeller 10B. As illustrated in FIG. 7 and FIG. 8, the conical rotor 130 includes a rotor core 131 and permanent magnets 140.

The rotor core 131 has an annular shape around the axis O, and extends in the axis O direction. The inside surface of the rotor core 131 is a rotor inside surface 132. The outside surface of the rotor core 131 is a rotor outside surface 133. The rotor core 131 has the rotor inside surface 132 and the rotor outside surface 133 forming a tapered shape inclined to the inner side in the radial direction, toward the downstream side. Thus, the rotor core 131 as a whole has a shape with a diameter decreasing toward the downstream side. The outer shape of the rotor core 131 is the outer shape of the conical rotor 130. The taper angles of the rotor inside surface 132 and the rotor outside surface 133 are the same and constant entirely over the axis O direction. Thus, in the cross section including the axis O, the rotor inside surface 132 and the rotor outside surface 133 are parallel to each other.

The rotor inside surface 132 is fitted to the tapered fix surface 33 of the outer circumference ring 30 of the second propeller 10B from the outer circumference side. Thus, the rotor core 131 is integrally fixed to the outer circumference ring 30 of the second propeller 10B. The taper angle of the rotor inside surface 132 and the taper angle of the tapered fix surface 33 are the same. The inside diameter of the rotor inside surface 132 and the outside diameter of the tapered fix surface 33 are the same at any position in the axis O direction, and thus are the same entirely over the axis O direction.

An insertion hole 134 through which the upstream side end surface and the downstream side end surface of the rotor core 131 are in communication with each other is formed in the rotor core 131. A plurality of the insertion holes 134 are provided at an interval in the circumferential direction. The insertion hole 134 extends in parallel with the rotor inside surface 132 and the rotor outside surface 133. In other words, the insertion hole 134 extends to be inclined to the inner side in the radial direction, toward the downstream side. The dimension of the insertion hole 134 in the radial direction is the same over the axis O direction. The insertion hole 134 is formed to have a distance between its side surfaces, facing each other in the circumferential direction, decreasing toward the downstream side.

<Permanent Magnets>

As illustrated in FIG. 7 and FIG. 8, a plurality of the permanent magnets 140 are provided at an interval from the rotor core 131 in the circumferential direction. Each permanent magnet 140 is inserted in a corresponding one of the insertion holes 134 of the rotor core 131.

Figure 11:
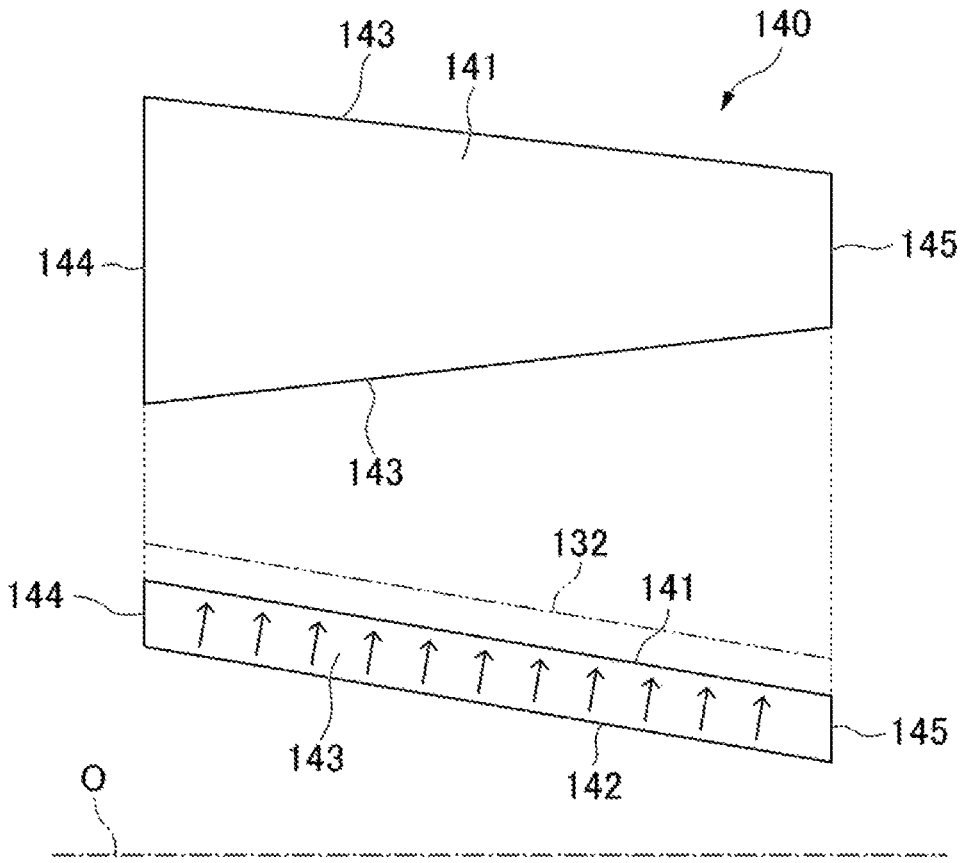
FIG. 11 is a two-view drawing illustrating a permanent magnet of a conical rotor.

As illustrated in FIG. 11, the permanent magnet 140 has a flat plate shape. In a state of being inserted in the insertion hole 134 of the rotor core 131, the permanent magnet 140 has a surface facing the outer side in the radial direction that is a magnet outside surface 141, and has a surface facing the inner side in the radial direction that is a magnet inside surface 142. The magnet outside surface 141 and the magnet inside surface 142 are parallel to each other, and each extend to be inclined to the inner side in the radial direction, toward the downstream side. The magnet outside surface 141 and the magnet inside surface 142 form a trapezoid shape with a dimension in the circumferential direction decreasing toward the downstream side, as viewed in the radial direction.

A pair of surfaces of the permanent magnet 140 facing the circumferential direction are magnet side surfaces 143. The pair of magnet side surfaces 143 connect the magnet outside surface 141 and the magnet inside surface 142 to each other in the radial direction over the axis O direction. The magnet side surfaces 143 extends toward the inner side in the radial direction toward the downstream side, as in the case of the magnet outside surface 141 and the magnet inside surface 142.

The surface of the permanent magnet 140 facing the upstream side is a magnet upstream surface 144. The magnet upstream surface 144 has a planar shape orthogonal to the axis O. The magnet upstream surface 144 is connected to upstream side end portions of the magnet outside surface 141, the magnet inside surface 142, and the pair of magnet side surfaces 143.

The surface of the permanent magnet 140 facing the downstream side is a magnet downstream surface 145. The magnet downstream surface 145 has a planar shape orthogonal to the axis O, and is parallel to the magnet upstream surface 144. The magnet downstream surface 145 is connected to downstream side end portions of the magnet outside surface 141, the magnet inside surface 142, and the pair of magnet side surfaces 143.

The magnetization direction of the permanent magnet 140 is a direction inclined to the downstream side, toward the outer side in the radial direction, as indicated by the arrows in FIG. 11. More specifically, the magnetization direction is a direction orthogonal to the magnet inside surface 142 and the magnet outside surface 141, and is a direction from the magnet inside surface 142 toward the magnet outside surface 141. The inclination angles of the magnet inside surface 142 and the magnet outside surface 141 relative to the axis O are the same as the taper angle of the rotor outside surface 133. Thus, the magnetization direction of the permanent magnet 140 is a direction orthogonal to the outside surface of the rotor. The permanent magnet 140 is uniformly magnetized in a direction along the magnet inside surface 142 and the magnet outside surface 141.

In the conical motor 90, the conical rotor 130 is rotationally driven about the axis O, by the rotating magnetic field generated when the coils 110 of the conical stator 100 are energized. The rotation direction of the conical motor 90 is opposite to the rotation direction of the tubular motor 80.

Thus, the rotational directions of the conical motor 90 and the tubular motor 80 are opposite to each other.

As illustrated in FIG. 10, the conical rotor 130 has the upstream side end portion in contact with the holding portion 34 from the downstream side, while being fixed to the outer circumference ring 30 of the second propeller 10B.

The downstream side end portion of the conical rotor 130 is held by a second holding plate 150 from the downstream side.

The downstream side end portion of the conical rotor 130 and the downstream end surface 35 of the outer circumference ring 30 each have a planar shape orthogonal to the axis O, and are arranged to be flush with each other. The second holding plate 150 is in contact with both the downstream side end portion of the conical rotor 130 and the downstream end surface 35 of the outer circumference ring 30. The second holding plate 150 has a plate shape extending entirely over the circumferential direction, in accordance with the shapes of the downstream side end portion of the conical rotor 130 and the downstream end surface 35 of the outer circumference ring 30.

This second holding plate 150 is fixed to the outer circumference ring 30 by a holding bolt 151. The holding bolt 151 is fastened to a bolt stop hole 150*a* formed to be recessed from the downstream end surface 35 of the outer circumference ring 30, after being inserted, from the downstream side, into the bolt stop hole 150*a* formed through the second holding plate 150 in the axis O direction.

As illustrated in FIG. 9 in addition to FIG. 10, one portion of the holding bolt 151 in the circumferential direction is accommodated in a notched portion 135 formed to be recessed from the outside surface of the rotor core 131, in a portion around an opening portion of the bolt stop hole 150*a*. The notched portion 135 is formed in a portion between the adjacent ones of the permanent magnets 140 in the circumferential direction in the rotor core 131.

An average outside diameter R2 of the conical rotor 130 of the conical motor 90 is set to be smaller than an average outside diameter R1 of the tubular rotor 82 of the tubular motor 80. In the present embodiment, the outside surface (rotor outside surface 133) of the conical rotor 130 extends with a uniform taper angle in the axis O direction. Thus, the average outside diameter R2 of the conical rotor 130 is the same as the outside diameter of the conical rotor 130 at the center in the axis O direction. With the tubular rotor 82 having a uniform outside diameter in the axis O direction, the average outside diameter R1 of the tubular rotor 82 is the same as the outside diameter of the tubular rotor 82 at any portion in the axis O direction.

The average inside diameter of the conical stator 100 of the conical motor 90 is set to be smaller than the average inside diameter of the tubular stator 81 of the tubular motor 80. In the present embodiment, the inside surface of the conical stator 100 extends with a uniform taper angle in the axis O direction. The average inside diameter of the conical stator 100 is the same as the inside diameter of the conical stator 100 at the center in the axis O direction. With the tubular stator 81 having a uniform inside diameter in the axis O direction, the average inside diameter of the tubular stator 81 is the same as the inside diameter of the tubular stator 81 at any portion in the axis O direction.

The average inside diameter of the conical motor 90 (the average inside diameter of the conical rotor 130: the inside diameter of the conical rotor 130 at the center in the axis O direction) is set to be smaller than the average inside diameter of the tubular motor 80 (tubular rotor 82) (the average inside diameter of the tubular rotor 82: the inside diameter of the tubular rotor 82 at any portion in the axis O direction).

In the present embodiment, the inside diameter of the upstream side end portion of the inside surface of the conical motor 90 is equal to or smaller than the inside diameter of the downstream side end portion of the inside surface of the tubular motor 80. That is, the inside diameter of the upstream side end portion of the inside surface of the conical motor 90 is set to be the same as that of the downstream side end portion of the inside surface of the tubular motor 80, or is set to be smaller than the inside diameter of the downstream side end portion of the inside surface of the tubular motor 80.

The average outside diameter of the conical motor 90 (the average outside diameter of the conical stator 100: the outside diameter of the conical stator 100 at the center in the axis O direction) is set to be smaller than the average outside diameter of the tubular motor 80 (tubular stator 81) (the average outside diameter of the tubular stator 81: the outside diameter of the tubular stator 81 at any portion in the axis O direction).

In the present embodiment, the outside diameter of the upstream side end portion of the outside surface of the conical motor 90 is equal to or smaller than the outside diameter of the downstream side end portion of the outside surface of the tubular motor 80. Specifically, the outside diameter of the upstream side end portion of the outside surface of the conical motor 90 is set to be the same as the outside diameter of the downstream side end portion of the outside surface of the tubular motor 80, or is set to be smaller than the outside diameter of the downstream side end portion of the outside surface of the tubular motor 80.

As described above, in the present embodiment, the average diameter of the conical motor 90, which is the motor on the downstream side, is set to be smaller than the average diameter of the tubular motor 80, which is the motor on the upstream side. Thus, an arrangement structure is obtained in which the conical motor 90, which is the motor on the downstream side, is shifted more on the inner side in the radial direction than the tubular motor 80, which is the motor on the upstream side.

<Operational Effects>

The underwater vehicle 1 having the configuration described above can cruise underwater, with the propulsion apparatus 8 driven. Specifically, when the tubular motor 80 in the first cavity 50A of the shroud 50 is driven, the first propeller 10A integrally fixed to the tubular rotor 82 of the tubular motor 80 rotates about the axis O, toward one side in the circumferential direction. As a result, the water is pumped toward the downstream side by the first blades 20A positioned in the flow path. When the conical motor 90 is driven simultaneously with the driving of the tubular motor 80, the second propeller 10B integrally fixed to the conical rotor 130 of the conical motor 90 rotates about the axis O toward the other side in the circumferential direction. As a result, the water is pumped toward the downstream side by the second blades 20B positioned in the flow path.

Then, thrust force toward the upstream side is generated at the first propeller 10A and the second propeller 10B, as a reaction force produced by the pumping of the water. The thrust force is transmitted to the shaft portion 3 from the inner circumference rings 11 of the first propeller 10A and the second propeller 10B, via the water film and the upstream side thrust bearing 42. As a result, the thrust force acts on the shaft portion 3 and the vehicle body 2 integrated therewith, whereby the underwater vehicle 1 is propelled.

In the propulsion apparatus 8 of the present embodiment, as illustrated in FIG. 2 and FIG. 3, the shroud 50 has the diameter decreasing toward the downstream side, and the shaft portion 3 has the diameter decreasing toward the downstream side. Thus, the flow path formed between the shroud 50 and the shaft portion 3 has a shape that is narrowed to the inner side in the radial direction toward the downstream side, meaning that the flow path cross-sectional area decreases toward the downstream side.

When the water is pumped by the first blades 20A and the second blades 20B, the flow rate of the water increases, resulting in the flow of the water narrowed on the inner side in the radial direction. In the present embodiment, the flow path has a shape suitable for the flow of the water, whereby water pumping efficiency can be improved.

Because the inside surface of the shroud 50 has the diameter decreasing toward the downstream side, the average diameter of the conical motor 90 positioned on the downstream side is set to be smaller than the average diameter of the tubular motor 80 positioned on the upstream side. Thus, an arrangement structure is obtained in which the motor on the downstream side is shifted more on the inner side in the radial direction than the motor on the upstream side.

If a plurality of motors have the same average outside diameter, that is, if the motors with the same diameter are simply arranged side by side in the axis O direction, the plurality of motors are arranged in the axis O direction to conflict with the shape of the inside surface of the shroud 50 with the decreasing diameter. In this case, the conflict between the shape of the shroud 50 and the arrangement structure of the plurality of motors requires the shroud 50 to conform to the arrangement structure of the motors. Thus, the shroud 50 might need to be undesirably upsized.

In view of this, in the present aspect, as described above, the arrangement structure has the conical rotor 130, which is the motor on the downstream side, shifted more on the inner side in the radial direction, and the arrangement structure conforms to the shape of the shroud 50 with the decreasing diameter. Thus, the shape of the shroud 50 does not need to be upsized to conform to the arrangement of the motors, whereby a compact configuration can be achieved.

In the present embodiment, the overall shape of the shroud 50 has the diameter gradually decreasing toward the downstream side, and thus has a tapered shape to have a smaller diameter toward the downstream side. In accordance with this shape of the shroud 50, the conical motor 90 accommodated in the shroud 50 also has a tapered shape with a diameter decreasing toward the downstream side. Thus, the conical motor 90 as the outer periphery driving device can be arranged along the shape of the shroud 50. Thus, the shape of the shroud 50 does not need to be undesirably upsized in accordance with the configuration of the motor, meaning that the shroud 50 as a whole can have a compact configuration.

In the present embodiment, with the shroud 50 thus having a compact configuration, drag in water while the underwater vehicle 1 is being propelled is small. Thus, the speed of the underwater vehicle 1 can be increased, and the propulsion efficiency can be improved.

Furthermore, in the present embodiment, the cross-sectional shape of the shroud 50 is of a blade form with the upstream side being the leading edge and the downstream side being the trailing edge, whereby drag in water can be minimized. Furthermore, the camber line of the blade form cross section of the shroud 50 is inclined to the inner side in the radial direction toward the downstream side, whereby the shroud 50 as a whole, forming the blade form, has a tapered shape with the diameter decreasing toward the downstream side. Thus, the shape of the shroud 50 conforms to the flow direction of the water pumped, whereby the pump efficiency can be further improved.

The conical motor 90 arranged in the shroud 50 has a tapered shape corresponding to the shape of the shroud 50, whereby the blade form shape of the shroud 50 does not need to be undesirably upsized in accordance with the conical motor 90. Thus, the shroud 50 can have a compact shape, while maintaining the blade form. Thus, drag in water during the propelling can be minimized.

When the water is sucked in, the drag in water tends to increase due to the pressure interference between the first blades 20A of the first propeller 10A positioned on the upstream side and the shaft portion 3. In particular, a configuration in which the load is concentrated over the entirety of the leading edge of each blade in order to improve propeller efficiency results in a significant drag in water.

On the other hand, in the present embodiment, as illustrated in FIGS. 4A and 4B, the load distribution on the suction side of the first blade 20A is of a balanced load type in which the load is distributed in the axis O direction with the load on the inner side in the radial direction being small. Thus, an increase in fluid drag due to the pressure interference can be minimized.

On the other hand, the suction side pressure distribution of the second blade 20B of the second propeller 10B on the downstream side, which is less likely to involve the pressure interference with the shaft portion 3, is of a leading edge load type in which the load is concentrated on the leading edge, so that the propeller efficiency can be improved.

As illustrated in FIG. 3, the thrust force of the first propeller 10A and the second propeller 10B is transmitted to the shaft portion 3 via the upstream side thrust bearing 42. In other words, the thrust force is transmitted to the upstream side thrust bearing 42 as a load. When the thrust force is large, the load transmitted to the upstream side thrust bearing 42 is also large, meaning that the load on the upstream side thrust bearing 42 is large.

In the present embodiment, when the conical motor 90 is driven, electromagnetic force acts in the direction (gap direction) in which the conical rotor 130 and the conical stator 100 of the conical motor 90 face. The electromagnetic force is in a direction toward the outer side in the radial direction and toward the downstream side. Thus, force toward the downstream side, as a component of the electromagnetic force in the axis O direction, is applied to the conical rotor 130.

Thus, on the conical rotor 130, force pulling it toward the downstream side acts. As a result, the load applied to the upstream side thrust bearing 42 from the second propeller 10B is reduced, whereby the thrust load produced by the upstream side thrust bearing 42 can be reduced.

Furthermore, in the present embodiment, by decoupling the coupling portion 70 illustrated in FIG. 5, the shroud 50 can be separated into a plurality of segments (the upstream segment 61, the intermediate segment 62, and the downstream segment 63). Thus, the tubular stator 81 of the tubular motor 80 and the conical stator 100 of the conical motor 90 illustrated in FIG. 3 can be easily attached in the shroud 50.

As illustrated in FIG. 5 and FIG. 6, the coupling portion 70 has a convex curved shape protruding from the outside surface of the shroud 50, and the cross-sectional shape along the outside surface of the shroud 50 is of a blade form with the upstream side being the protruding portion leading edge 70*a* and the downstream side being the protruding portion trailing edge 70*b*. Thus, drag due to the coupling portion 70 while the underwater vehicle 1 is being propelled can be suppressed.

The conical stator 100 of the conical motor 90 of the present embodiment is accommodated in the second cavity 50B, and between the intermediate segment 62 and the downstream segment 63 defining and forming the second cavity 50B, is fixed only to the second cavity 50B of the downstream side segment 63.

The force toward the downstream side, which is a component of the electromagnetic force, acts on the conical rotor 130 as described above, whereas the force toward the upstream side, which is a component of the electromagnetic force, acts on the conical stator 100, which is paired with the conical rotor 130. Thus, the force toward the upstream side also acts on the downstream segment 63, to which the conical stator 100 is integrally attached.

As a result, the downstream segment 63 is pressed against the intermediate segment 62 by the force. Thus, the downstream segment 63 and the intermediate segment 62 can be more rigidly fixed and integrated to each other, and the fastening force of the coupling portion 70 coupling these bodies can be relaxed. Accordingly, a fastening bolt with a smaller diameter can be used for the fastening portion, and the coupling portion 70 can be made compact, whereby the drag due to the coupling portion 70 against the flow of water can be further reduced.

The conical stator 100 of the conical motor 90 has a tapered shape corresponding to the shape of the shroud 50. This contributes to making the shroud 50 compact, while providing the function of the stator of the motor.

As illustrated in FIG. 9, the coil layers 120, forming the respective layers of the coil 110, have a configuration corresponding to the outer surface of the teeth 106, that is, a rectangular annular shape with a distance in the circumferential direction decreasing toward the downstream side, whereby the coil 110 can be arranged with a high density relative to the teeth 106.

Furthermore, as illustrated in FIG. 8, the coil layers 120, forming the respective layers of the coil 110, are inclined to the inner side in the radial direction toward the downstream side, in accordance with the tapered shape of the teeth 106. Thus, the coil 110 can be arranged with a high density relative to the stator core 101 of the conical stator 100.

The positions of the upstream side end portion and the downstream side end portion of the coil ends 111 in the axis O direction are the same among the coil layers 120, whereby the coil 110 can be highly densely arranged with a compact dimension in the axis O direction.

If the coil layers 120, formed using the rectangular copper wires with the same cross-sectional shape, are stacked without the positions of the end portions of the coils 110 in the axis O direction matching, a gap is formed between the coil layers 120 and the teeth 106 in the axis O direction. In such a case, the amount of leakage magnetic flux is large, and thus the motor efficiency is compromised. In the present embodiment, the coil layers 120 can be highly densely arranged with the gap between the coil layers 120 and the teeth 106 minimized. Thus, the motor efficiency can be improved.

Furthermore, the coil 110 as a whole can have a shorter length, whereby the copper loss of the coil 110 can be reduced, so that the efficiency of the motor can be improved.

In the present embodiment, the upstream side end portion of the coil layer 120 forming each layer of the coil 110 is configured to be bent to be parallel to the axis O. Thus, the gap between the rectangular copper wire and the teeth 106 at the coil end 111 can be minimized, while increasing the density of the layers at the coil end 111.

The conical rotor 130 of the conical motor 90 has a tapered shape corresponding to the tapered shape of the shroud 50. This contributes to making the shroud 50 compact, while providing the function of the rotor of the motor.

Furthermore, in the present embodiment, the magnetization direction of the permanent magnet 140 is orthogonal to the rotor outside surface 133 of the conical rotor 130, instead of simply being in the radial direction. In other words, the magnetization direction of the permanent magnets 140 matches the direction in which the rotor and the stator face. Thus, the contribution of the permanent magnet 140 to the torque can be maximized, whereby the torque of the conical motor 90 can be improved.

The electromagnetic force toward the outer side in the radial direction and the downstream side acts on the rotor core 131 of the conical motor 90. In view of this, in the present embodiment, the rotor core 131 is held by the second holding plate 150 from the downstream side, and thus can be prevented from falling down toward the downstream side.

The thickness of the downstream end of the outer circumference ring 30 of the second propeller 10B in the radial direction is small. Thus, a bolt hole 36 might be difficult to form in a portion of the downstream end of the outer circumference ring 30. Formation of the bolt hole 36 despite such difficulty leads to insufficient strength of the outer circumference ring 30, and thus is not preferable. On the other hand, in the present embodiment, the notched portion 135 receiving a part of the outside surface of the holding bolt 151 is formed in the rotor. Thus, the holding bolt 151 is inserted to be guided into the notched portion 135. A part of the load from the holding bolt 151 can be received by the notched portion 135. Thus, the holding bolt 151 can be appropriately fixed with respect to the outer circumference ring 30, whereby the rotor core 131 can be more effectively prevented from falling by the second holding plate 150.

The movement of the rotor core 131 relative to the outer circumference ring 30 in the circumferential direction can be restricted by the notched portion 135. Thus, the rotor core 131 can be prevented from undesirably displaced in the circumferential direction, and the rotor core 131 and the outer circumference ring 30 can be more rigidly fixed to each other.

The notched portion 135 is formed in a portion between the adjacent ones of the permanent magnets 140, in the rotor core 131. If the notched portion 135 is formed in a portion on the outer side in the radial direction of the permanent magnet 140, passage of a magnetic flux through the rotor core 131 is hindered, resulting in an increase in the magnetic resistance. With the notched portion 135 formed between the adjacent permanent magnets 140 as in the present embodiment, erosion of the magnetic path of the rotor core 131 can b e minimized, whereby the increase in the magnetic resistance can be suppressed.

OTHER EMBODIMENTS

The embodiment of the disclosure has been described above, but the disclosure is not limited thereto, and may be modified as appropriate within a range that does not deviate from the technical concept of the disclosure.

In the embodiment, an example is described in which only the motor that drives the second propeller 10B, of the two propellers, the first propeller 10A and the second propeller 10B, is the conical motor 90. However, the disclosure is not limited thereto.

Specifically, it suffices if the same number of motors are provided as the number of a plurality of propellers to correspond to the respective propellers. The motors may each be of a tubular type or a conical type.

When the plurality of motors are three or more motors arranged side by side in the axis O direction, the arrangement structure may be such that the motor average diameter decreases toward the downstream side. In other words, any arrangement structure may be employed as long as the motor positioned more on the downstream side is shifted more on the inner side in the radial direction.

The outside diameter of the upstream side end portion of the rotor of the motor on the downstream side may be larger than the outside diameter of the downstream side end portion of the rotor of the motor on the upstream side. Also in this case, it suffices if the average outside diameter of the rotor of the motor on the downstream side is smaller than the average outside diameter of the rotor of the motor on the upstream side. Also with this configuration, an arrangement structure can be achieved in which the motor on the downstream side is shifted more on the inner side in the radial direction than the motor on the upstream side.

The inside diameter of the upstream side end portion of the stator of the motor on the downstream side may be larger than the inside diameter of the downstream side end portion of the stator of the motor on the upstream side. Also in this case, it suffices if the average inside diameter of the stator of the motor on the downstream side is smaller than the average inside diameter of the stator of the motor on the upstream side. Also with this configuration, an arrangement structure can be achieved in which the motor on the downstream side is shifted more on the inner side in the radial direction than the motor on the upstream side.

The diameter (inside diameter, outside diameter) of the upstream side end portion of the motor on the downstream side may be larger than the diameter (inside diameter, outside diameter) of the downstream side end portion of the motor on the upstream side. Also in this case, it suffices if the average diameter (the average inside diameter, the average outside diameter) of the motor on the downstream side is smaller than the average diameter (the average inside diameter, the average outside diameter) of the motor on the upstream side. Also with this configuration, an arrangement structure can be achieved in which the motor on the downstream side is shifted more on the inner side in the radial direction than the motor on the upstream side.

In the embodiment, an example is described in which the cross-sectional shape of the shroud 50 is of a blade form. However, the blade form should not be construed in a limiting sense. The cross-sectional shape of the shroud 50 is preferably a streamline shape, but may be other shapes such as a rectangular shape, for example. Also in this case, with the shroud 50 having the diameter decreasing toward the downstream side, a flow path with a flow path cross-sectional area decreasing toward the downstream side is defined and formed.

The shroud 50 may have any shape, as long as the shroud inside surface 51 has a diameter decreasing toward the downstream side. In other words, the shape of the shroud outside surface 52 may not have a diameter decreasing toward the downstream side.

In the embodiment, an example is described in which the shroud 50 is split into three segments, in accordance with the number of motors. However, the disclosure is not limited to this, and a configuration may be employed in which the shroud 50 is split into two in the axis O direction with the outer circumference ring 30 of the propeller and motor disposed therebetween. Furthermore, a configuration may be employed in which the shroud 50 is split into four or more in the axis O direction, with the outer circumference ring 30 of the propeller and motor disposed between adjacent ones of the segments.

In the embodiment, a configuration is described in which the conical stator 100 of the conical motor 90 is fixed only to the downstream segment 63, out of the intermediate segment 62 and the downstream segment 63. However, the disclosure is not limited to this. The conical stator 100 may be fixed not only to the downstream segment 63, but may also be fixed to the intermediate segment 62. Thus, the stator of the motor may be fixed to both of the adjacent segments.

More preferably, the conical stator 100 may be fixed to only the downstream side segment, of the adjacent segments. With this configuration, as in the embodiment, the adjacent segments may be more rigidly fixed in the axis O direction, and the coupling portion 70 can be made compact.

Figure 12:
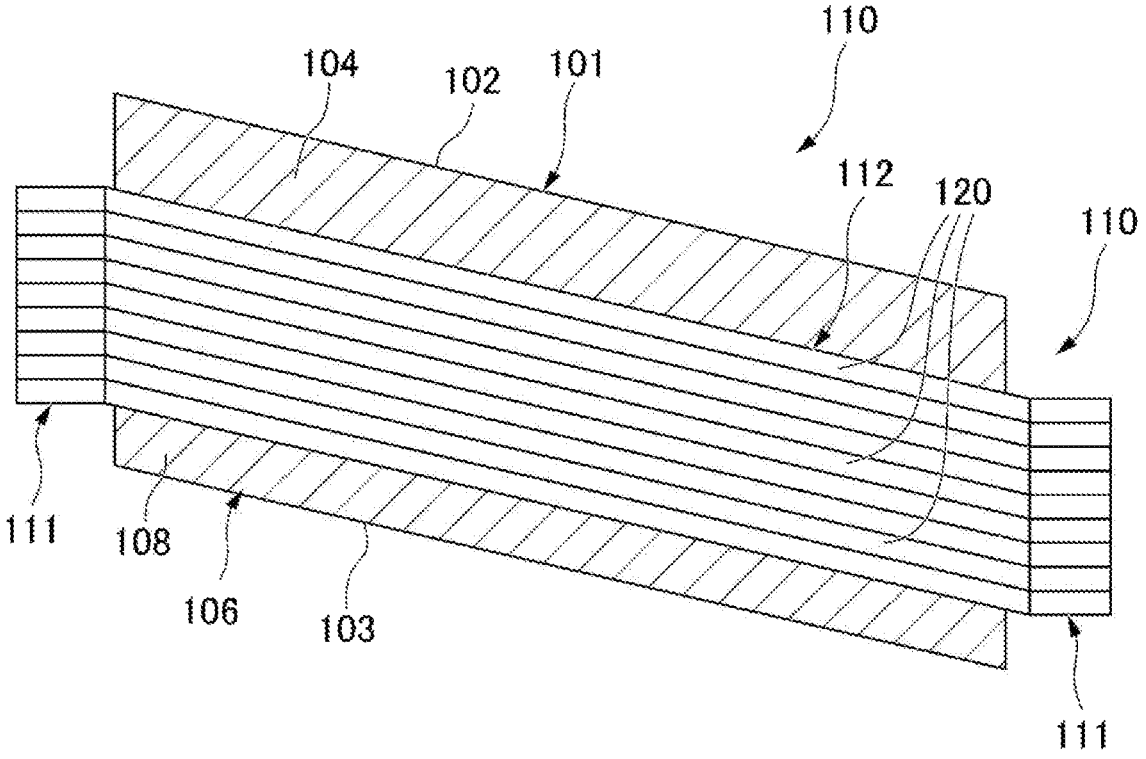
FIG. 12 is a vertical cross-sectional view of a conical stator according to a first modification.
Figure 13:
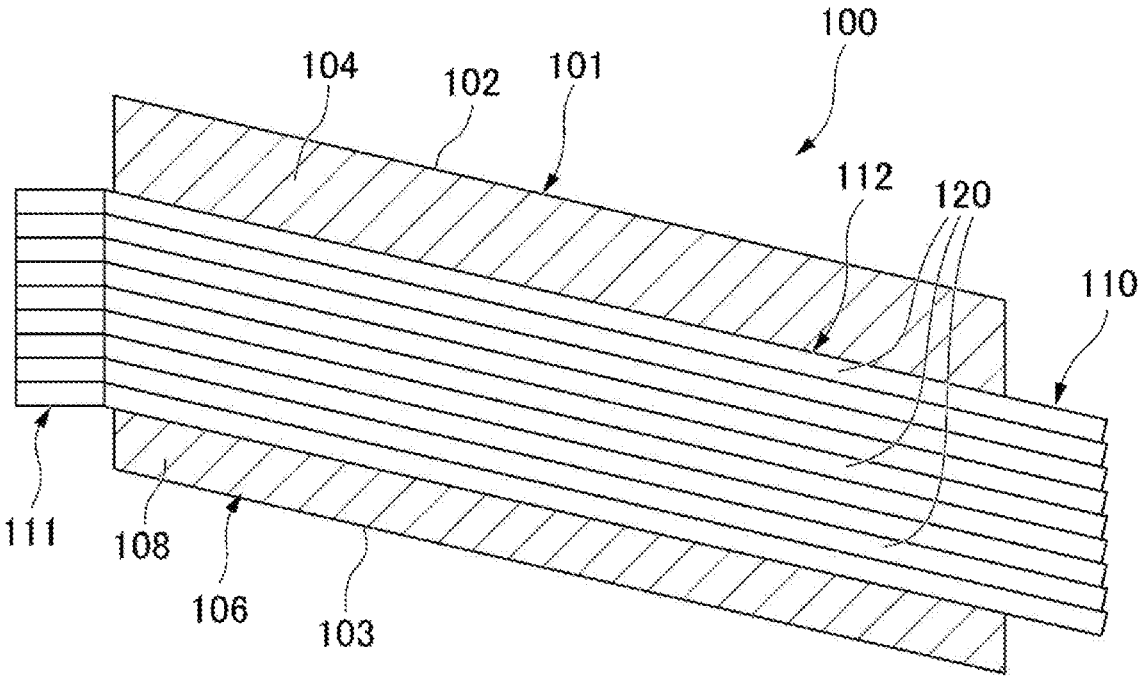
FIG. 13 is a vertical cross-sectional view of a conical stator according to a second modification.

In the embodiment, an example is described in which, out of the coil ends 111 on the upstream side and the downstream side, only the coil end 111 on the upstream side is bent to be parallel to the axis O. However, the disclosure is not limited to this, and as a first modification, for example, the coil ends 111 on the upstream side and the downstream side may both have a shape bent to be parallel to the axis O as illustrated in FIG. 12. Furthermore, as a second modification, as illustrated in FIG. 13, a shape may be employed in which only the coil end 111 on the downstream side is bent to be in the axis O direction. Also with these configurations, operational effects as those in the embodiment can be obtained.

Furthermore, in the embodiment, an example is described in which the fluid machine according to the disclosure is applied to the propulsion apparatus 8 of the underwater vehicle 1. However, the disclosure is not limited to this, and for example, the fluid machine may be applied to the propulsion apparatus 8 of a ship or the like that cruises on water.

The fluid machine according to the disclosure is not limited to the propulsion apparatus 8, and may be applied to other fluid machines used underwater such as a pump. Furthermore, the disclosure is not limited to a fluid machine that pumps water, and may be applied to a fluid machine that pumps other types of liquid such as oil.

Notes

The propulsion apparatus (fluid machine) 8 and the underwater vehicle 1 described in each of the embodiments are construed as follows, for example.

(1) A fluid machine according to a first aspect includes: a shaft portion 3 extending in an axis O direction; a shroud 50 provided to surround the shaft portion 3 and having an inside surface with a diameter decreasing from an upstream side on one side in the axis O direction toward a downstream side on another side in the axis O direction, a flow path being formed between the shroud 50 and the shaft portion 3 and having a flow path cross-sectional area decreasing toward the downstream side; a propeller rotatably provided about the axis O between the shaft portion 3 and the shroud 50 and configured to pump a fluid from the upstream side toward the downstream side; and a motor provided to correspond to the propeller and including a rotor having a ring-like shape fixed to an outer circumference portion of the propeller and accommodated in the shroud 50 and a stator having a ring-like shape surrounding the rotor and fixed in the shroud 50, in which a plurality of the propellers are provided to be spaced apart in the axis O direction, the motors are provided in an identical number to the propellers to correspond to each of the propellers, and of a plurality of motors, the rotor of the motor positioned more on the downstream side has a smaller average outside diameter.

With the configuration described above, the inside surface of the shroud 50 has the diameter decreasing toward the downstream side, and the flow path cross-sectional area of the flow path on the inner side decreases toward the downstream side, whereby pumping efficiency of a fluid can be improved.

Because the inside surface of the shroud 50 has the diameter decreasing toward the downstream side, the average outside diameter of the rotors of the plurality of motors decreases toward the downstream side. Thus, an arrangement structure is obtained in which the motor on the downstream side is shifted more on the inner side in the radial direction.

If a plurality of motors have the same average outside diameter, the motors are arranged side by side with their positions in the radial direction being the same, relative to the shape of the inside surface of the shroud 50 with the decreasing diameter. In this case, due to the conflict between the shape of the shroud 50 and the arrangement structure of the plurality of motors, the shroud 50 needs to conform to the arrangement structure of the motors, resulting in upsizing of the shroud 50.

In view of this, in the present aspect, as described above, the arrangement structure has the motor on the downstream side shifted more on the inner side in the radial direction, so the arrangement structure conforms to the shape of the shroud 50 with the decreasing diameter. Thus, the shape of the shroud 50 does not need to be upsized to conform to the arrangement of the motors, whereby a compact configuration can be achieved.

(2) A fluid machine according to a second aspect is the fluid machine according to (1), in which, of the motors adjacent to each other in the axis direction, an average inside diameter of the stator of the motor positioned on the downstream side is smaller than an average inside diameter of the stator of the motor positioned on the upstream side, and an average outside diameter of the rotor of the motor positioned on the downstream side is smaller than an average outside diameter of the rotor of the motor positioned on the upstream side.

As a result, the inside diameter and the outside diameter of a motor group including a plurality of motors conform to the shape of the shroud 50 with the decreasing diameter. Thus, the shroud 50 can be further made compact.

(3) A fluid machine according to a third aspect is the fluid machine according to (1) or (2), in which the shroud 50 has a cross-sectional shape, orthogonal to the axis O, of a blade form with an end portion on the upstream side corresponding to a leading edge and an end portion on the downstream side corresponding to a trailing edge.

The cross-sectional shape of the shroud 50 is of a blade form, whereby drag due to a flow of water can be minimized when the fluid machine is disposed underwater. A shape is achieved that conforms to the flow direction of the fluid pumped by the propeller, whereby the pump efficiency can be further improved.

On the other hand, in order to maintain the blade form while accommodating the plurality of motors inside, the shape of the shroud 50 may need to be upsized more than required to conform to the arrangement structure of the plurality of motors. In view of this, in the present aspect, the arrangement structure of the plurality of motors conforms to the shape of the shroud 50, whereby the size of the shroud 50 can be reduced.

(4) A fluid machine according to a fourth aspect is the fluid machine according to any one of (1) to (3), in which two of the propellers are provided in the axis direction, the two propellers have rotational directions opposite to each other, each of the propellers includes a plurality of blades arranged in a circumferential direction, a suction side pressure distribution of the blade of the propeller on the downstream side is of a leading edge load type with a load concentrated on a leading edge, and a suction side pressure distribution of the blade of the propeller on the upstream side is of a balanced load type, with a load more distributed in the axis O direction than in the suction side pressure distribution of the blade on the downstream side, with a load being smaller on an inner side in a radial direction.

Here, between the blade on the upstream side and the shaft portion 3, fluid drag tends to increase due to pressure interference in sucking water. In particular, a configuration in which the load is concentrated over the entirety of the leading edge of the blade in order to improve propeller efficiency makes this tendency more significant. In the present aspect, the suction side pressure distribution of the blade on the upstream side is of a balanced load type, and thus, an increase in fluid drag due to the pressure interference can be minimized.

On the other hand, the suction side pressure distribution of the blade on the downstream side is of a leading edge load type in which the load is concentrated on the leading edge, so that the propeller efficiency can be improved.

(5) A fluid machine according to a fifth aspect is the fluid machine according to any one of (1) to (4), in which the propeller includes an inner circumference ring 11 fitted to an outer circumference side of the shaft portion 3 across a clearance, and the fluid machine further includes: a thrust bearing fixed to the shaft portion 3 and facing the upstream side of the inner circumference ring 11 entirely over a circumferential direction; and a strut 78 supporting the shroud 50 relative to the shaft portion 3.

When the propeller is rotating, a load is applied on the propeller itself toward the upstream side as a reaction force produced by pumping of a fluid. The load on the propeller is supported by the thrust bearing. When the conical motor is being driven, the electromagnetic force toward the outer side in the radial direction and the downstream side acts on the conical rotor 130. Thus, on the conical rotor 130, force to pull it toward the downstream side acts. As a result, the load applied to the thrust bearing from the propeller is reduced, whereby the thrust load can be reduced.

(6) A fluid machine according to a sixth aspect is the fluid machine according to any one of (1) to (5), in which the shroud 50 includes a plurality of segments split into a plurality of pieces in the axis O direction, and the fluid machine further includes a coupling portion 70 coupling the plurality of segments in the axis O direction.

By decoupling the coupling portion 70, the shroud 50 can be separated into a plurality of segments. This makes it easy to attach the rotor and the stator of the motors in the shroud 50.

(7) A fluid machine according to a seventh aspect is the fluid machine according to (6), in which the coupling portion 70 has a convex curved shape protruding from an outside surface of the shroud 50, and a cross-sectional shape along the outside surface of the shroud 50 is of a blade form with the upstream side being a leading edge and the downstream side being a trailing edge.

Thus, drag due to the coupling portion 70 can be suppressed when water is flowing on the outside surface of the shroud 50.

(8) A fluid machine according to an eighth aspect is the fluid machine according to any one of (1) to (7), in which at least one of the plurality of motors is a conical motor 90 in which the rotor and the stator have a diameter decreasing from the upstream side toward the downstream side.

By employing the conical motor 90 having the rotor and the stator with a diameter decreasing toward the downstream side as the motor, the shape of the individual motors can conform to the shape of the shroud 50. Thus, the shape of the shroud 50 does not need to be upsized to conform to the configuration of the motors, whereby a compact configuration can be achieved.

(9) A fluid machine according to a ninth aspect is the fluid machine according to (8), in which the stator includes: a stator core 101 including a back yoke 104 forming an annular shape around the axis O and having a diameter decreasing toward the downstream side, and a plurality of teeth 106 protruding from an inside surface of the back yoke 104 to the inner side in a radial direction, extending in a circumferential direction entirely over the axis O direction, and having a thickness in the circumferential direction decreasing, with a diameter decreasing, toward the downstream side; and a plurality of coils 110 provided to surround an outer surface of each of the teeth 106.

As a result, the configuration of the stator can have a conical shape that conforms to the shape of the shroud 50 with the decreasing diameter.

(10) A fluid machine according to a tenth aspect is the fluid machine according to (9), in which each of the coils 110 includes a rectangular copper wire having a flat shape with a plurality of layers stacked in the radial direction around the teeth 106, and each layer of the coil 110 has a rectangular shape with a distance in the circumferential direction decreasing toward the downstream side, as viewed in the radial direction.

By configuring the shape of respective layers of the coil 110 that conforms to the teeth 106, the coil 110 can be arranged with a high density relative to the teeth 106.

(11) A fluid machine according to an eleventh aspect is the fluid machine according to (10), in which each layer of the coil 110 is inclined to the inner side in the radial direction toward the downstream side.

As a result, the coil 110 can be efficiently disposed, with respect to the teeth 106 extending to be inclined to the inner side in the radial direction toward the downstream side.

(12) A fluid machine according to a twelfth aspect is the fluid machine according to (11), in which the coil 110 has axis O direction positions of an end portion of a coil end 111 in the axis O direction matching each other in each layer.

With this configuration, the coil 110 can be highly densely arranged with a compact dimension in the axis O direction. Because the coil 110 as a whole has a shorter length, the efficiency of the motor can be improved.

(13) A fluid machine according to a thirteenth aspect is the fluid machine according to (12), in which a portion of each layer of the coil 110 forming the coil end 111 is bent to be in parallel with the axis O.

Thus, the gap between the rectangular copper wire and the teeth 106 at the coil end 111 can be minimized, while increasing the density of the layers at the coil end 111.

(14) A fluid machine according to a fourteenth aspect is the fluid machine according to any one of (8) to (13), in which the rotor includes: a rotor core 131 forming a tubular shape around the axis O and having a diameter decreasing toward the downstream side; and a plurality of permanent magnets 140 provided at an interval from the rotor core 131 in a circumferential direction and extending entirely over the axis O direction, and the permanent magnets 140 extend to be inclined to an inner side in a radial direction toward the downstream side and have a width in the circumferential direction decreasing toward the downstream side.

As a result, the configuration of the rotor can have a conical shape that conforms to the shape of the shroud 50 with the decreasing diameter.

(15) A fluid machine according to a fifteenth aspect is the fluid machine according to (14), in which a magnetization direction of the permanent magnets 140 is orthogonal to an outside surface of the rotor.

The magnetization direction of the permanent magnet 140 matches the direction in which the rotor and the stator face, instead of simply being in the radial direction, whereby the torque of the motor can be improved.

(16) A fluid machine according to a sixteenth aspect is the fluid machine according to (14) or (15), in which the propeller further includes an outer circumference ring 30 having a ring-like shape forming the outer circumference portion of the propeller, the rotor core 131 is fitted to an outside surface of the outer circumference ring 30, and the fluid machine further includes: a holding plate that is in contact with end portions of the outer circumference ring 30 and the rotor core 131 on the downstream side; and a holding bolt 151 provided through the holding plate in the axis O direction and fixing the holding plate to the outer circumference ring 30.

The electromagnetic force toward the outer side in the radial direction and the downstream side acts on the rotor core 131 of the conical motor 90. In view of this, the rotor core 131 is held by the holding plate from the downstream side, and thus can be suppressed from falling down.

(17) A fluid machine according to a seventeenth aspect is the fluid machine according to (16), in which the outer circumference ring 30 has a thickness in the radial direction decreasing toward the downstream side, and a notched portion 135 is formed in a portion between adjacent ones of the permanent magnets 140 at an end portion of the rotor core 131 on the downstream side, the notched portion 135 receiving a part of an outside surface of the holding bolt 151 inserted into the holding plate.

The thickness of the downstream end of the outer circumference ring 30 in the radial direction is small. Thus, the bolt hole 36 may fail to be formed in a portion of the downstream end of the outer circumference ring 30 depending on the diameter of the bolt. On the other hand, the notched portion 135 receiving a part of the outside surface of the holding bolt 151 is formed in the rotor. Thus, insertion of the holding bolt 151 is allowed, so that the holding bolt 151 can be appropriately fixed with respect to the outer circumference ring 30.

The movement of the rotor core 131 relative to the outer circumference ring 30 in the circumferential direction can be restricted by the notched portion 135.

Furthermore, with the notched portion 135 formed in a portion between the permanent magnets 140 in the rotor core 131, erosion of the magnetic path of the rotor core 131 can be minimized, whereby the increase in the magnetic resistance can be suppressed.

(18) An underwater vehicle 1 according to an eighteenth aspect includes: a vehicle body 2; and a propulsion apparatus 8 provided to the vehicle body 2, in which the propulsion apparatus 8 is the fluid machine described in any one of (1) to (17).

With such an underwater vehicle 1, the propulsion apparatus 8 can be made compact, while the propulsion efficiency is improved.

While preferred embodiments of the invention have been described as above, it is to be understood that variations and modifications will be apparent to those skilled in the art without departing from the scope and spirit of the invention. The scope of the invention, therefore, is to be determined solely by the following claims.

The invention claimed is:

1. A fluid machine for an underwater vehicle comprising:

a shaft portion extending in an axis direction;

a shroud provided to surround the shaft portion and having an inside surface with a diameter decreasing from an upstream side on one side in the axis direction toward a downstream side on another side in the axis direction, a flow path being formed between the shroud and the shaft portion and having a flow path cross-sectional area decreasing toward the downstream side;

a plurality of propellers rotatably provided about an axis between the shaft portion and the shroud and configured to pump a fluid from the upstream side toward the downstream side; and a plurality of motors provided to correspond to the propellers, respectively, each motor including a rotor having a ring shape fixed to an outer circumference portion of a corresponding one of the propellers and accommodated in the shroud and a stator having a ring shape surrounding the rotor and fixed in the shroud, wherein the plurality of propellers are spaced apart in the axis direction, the plurality of motors are provided in an identical number to that of the plurality of propellers, the plurality of motors include a conical motor and a tubular motor, and an average outside diameter of the rotor of the conical motor is smaller than an average outside diameter of the rotor of the tubular motor.

2. The fluid machine according to claim 1, wherein, of the plurality of motors, the conical motor and the tubular motor are adjacent to each other in the axis direction, an average inside diameter of the stator of the conical motor is smaller than an average inside diameter of the stator of the tubular motor, and the conical motor is positioned downstream of the tubular motor.

3. The fluid machine according to claim 1, wherein the shroud has a cross-sectional shape, orthogonal to the axis, of a blade form with an end portion on the upstream side corresponding to a leading edge and an end portion on the downstream side corresponding to a trailing edge.

4. The fluid machine according to claim 1, wherein the plurality of propellers includes a first propeller and a second propeller provided in the axis direction, wherein the second propeller is arranged downstream of the first propeller, the first and second propellers have respective rotational directions opposite to each other, each of the first and second propellers includes a plurality of blades arranged in a circumferential direction, a suction side pressure distribution of each blade of the second propeller has a load concentrated on a leading edge, and for each blade of the first propeller, a suction side pressure distribution has a load balanced, with a load more distributed in the axis direction than in the suction side pressure distribution of the blade, and with a load being smaller on an inner side of the blade in a radial direction.

5. The fluid machine according to claim 1, wherein each propeller includes an inner circumference ring fitted to an outer circumference side of the shaft portion across a clearance, and the fluid machine further includes:

a thrust bearing fixed to the shaft portion and facing the upstream side of the inner circumference ring entirely over a circumferential direction; and a strut supporting the shroud relative to the shaft portion.

6. The fluid machine according to claim 1, wherein the shroud includes a plurality of segments split into a plurality of pieces in the axis direction, and the fluid machine further includes a coupling portion coupling the plurality of segments in the axis direction.

7. The fluid machine according to claim 6, wherein the coupling portion has a convex curved shape protruding from an outside surface of the shroud, and a cross-sectional shape along the outside surface of the shroud is of a blade form with an upstream side of the cross-sectional shape being a leading edge and a downstream side of the cross-sectional shape being a trailing edge.

8. The fluid machine according to claim 1, wherein the rotor and the stator of the conical motor have a diameter decreasing from the upstream side toward the downstream side.

9. The fluid machine according to claim 8, wherein the stator of the conical motor includes:

a stator core including a back yoke forming an annular shape around the axis and having a diameter decreasing toward the downstream side, and a plurality of teeth protruding from an inside surface of the back yoke toward an inner side in a radial direction, extending in a circumferential direction entirely over the axis direction, and having a thickness in the circumferential direction decreasing, with a diameter decreasing, toward the downstream side; and a plurality of coils provided to respectively surround an outer surface of each of the teeth.

10. The fluid machine according to claim 9, wherein each coil includes a rectangular copper wire having a flat shape with a plurality of layers stacked in the radial direction around a corresponding one of the teeth, and for each coil, each layer of the coil has a rectangular shape with a distance in the circumferential direction decreasing toward the downstream side, as viewed in the radial direction.

11. The fluid machine according to claim 10, wherein for each coil, each layer of the coil is inclined to the inner side in the radial direction toward the downstream side.

12. The fluid machine according to claim 11, wherein for each coil, each layer of the coil has a coil end portion, and wherein each coil end portion ends at a same position with respect to the axis direction.

13. The fluid machine according to claim 12, wherein for each coil, each coil end portion is bent so as to be parallel to the axis.

14. The fluid machine according to claim 8, wherein the rotor of the conical motor includes:

a rotor core forming an annular shape around the axis and having a diameter decreasing toward the downstream side; and a plurality of permanent magnets provided at an interval from the rotor core in a circumferential direction and extending entirely over the axis direction, and wherein the permanent magnets extend and are inclined to an inner side in a radial direction toward the downstream side and have a width in the circumferential direction decreasing toward the downstream side.

15. The fluid machine according to claim 14, wherein a magnetization direction of the permanent magnets is orthogonal to an outside surface of the rotor of the conical motor.

16. The fluid machine according to claim 14, wherein each propeller further includes an outer circumference ring having a ring shape forming the outer circumference portion of the propeller, the rotor core of the conical motor is fitted to an outside surface of the outer circumference ring of the corresponding one of the propellers, and the fluid machine further includes:

a holding plate that is in contact with a downstream side end of the rotor core of the conical motor and a downstream side end of the outer circumference ring of the corresponding one of the propellers; and a holding bolt provided through the holding plate in the axis direction and fixing the holding plate to the outer circumference ring of the corresponding one of the propellers.

17. The fluid machine according to claim 16, wherein the outer circumference ring of each propeller has a thickness in the radial direction decreasing toward the downstream side, and a notched portion is formed in a portion between adjacent ones of the permanent magnets at an end portion of the rotor core on the downstream side, the notched portion receiving a part of an outside surface of the holding bolt inserted into the holding plate.

18. An underwater vehicle comprising:

a vehicle body; and a propulsion apparatus provided to the vehicle body, wherein the propulsion apparatus is the fluid machine according to claim 1.

* * * * *